US006230594B1

(12) United States Patent
Jalbert et al.

(10) Patent No.: US 6,230,594 B1
(45) Date of Patent: May 15, 2001

(54) POWER-OPERATED SCREWDRIVING DEVICE

(75) Inventors: David B. Jalbert, Coventry, RI (US); David J. Buzzeo, Brighton, MA (US); James A. Russell, East Greenwich, RI (US)

(73) Assignee: Stanley Fastening Systems, L.P., East Greenwich, RI (US)

( * ) Notice: Subject to any disclaimer, the term of this patent is extended or adjusted under 35 U.S.C. 154(b) by 0 days.

(21) Appl. No.: 09/151,779

(22) Filed: Sep. 11, 1998

Related U.S. Application Data

(60) Provisional application No. 60/058,865, filed on Sep. 12, 1997.

(51) Int. Cl.[7] ..... B25B 23/04

(52) U.S. Cl. ..... 81/434; 81/57.37; 81/431; 81/435

(58) Field of Search ..... 81/57.37, 431, 81/434, 435

(56) References Cited

U.S. PATENT DOCUMENTS 2,202,240 * 5/1940 Trotter .
2,538,350 * 1/1951 Baule .

(List continued on next page.)

FOREIGN PATENT DOCUMENTS 38 08 534 * 9/1989 (DE) .
42 08 715 * 9/1992 (DE) .

(List continued on next page.)

*Primary Examiner*—David A. Scherbel
*Assistant Examiner*—Shantese McDonald

(74) *Attorney, Agent, or Firm*—Pillsbury Madison & Sutro LLP

(57) ABSTRACT

The present invention is a power-operated screwdriving device configured to be used with a rotary power source and a supply of collated screws. The device comprises a housing structure and a feeding assembly defines a drive track carried by the housing and providing a workpiece engaging surface. The drive track is configured to receive a lead screw from the supply. A rotatable screw engaging bit member is constructed and arranged to be operatively connected to the rotary power source such that the rotary power source rotates the screw engaging bit member during a screwdriving operation. The rotatable screw engaging bit member is movable relative to the drive track and the workpiece engaging surface such that, when the workpiece engaging surface is engaged with the surface of the workpiece, rotation of the bit member and relative movement between the bit member and the drive track drives the lead screw into the workpiece during the screwdriving operation. Screw depth setting structure provides a feeding assembly engaging surface. The screw depth setting structure is positioned and configured such that the feeding assembly engaging surface engages the feeding assembly to thereby limit the relative movement occurring between the screw engaging bit member and the workpiece engaging surface during the screwdriving operation. The workpiece engaging surface and the rotatable screw engaging bit member are constructed and arranged such that, when the feeding assembly is engaged with the feeding assembly engaging surface, a distance between a screw engaging end portion of the bit member and the workpiece engaging surface determines the depth to which the lead screw will be driven relative to the surface of the workpiece during the screwdriving operation. A manually engageable screw depth adjusting member is disposed exteriorly of the housing structure and operatively connected to the screw depth setting structure. The screw depth adjusting member is constructed and arranged such that manual operation thereof moves the screw depth setting structure through a range of adjustable positions to thereby adjust the depth to which the lead screw will be driven to the surface of the workpiece during the screwdriving operation.

49 Claims, 24 Drawing Sheets

U.S. PATENT DOCUMENTS

| | | | | |
|---|---|---|---|---|
| 2,646,091 | | 7/1953 | Austin . | |
| 3,854,648 | * | 12/1974 | Inzoli et al. . | |
| 3,910,124 | | 10/1975 | Halsey . | |
| 3,910,324 | | 10/1975 | Nasiatka . | |
| 3,930,297 | * | 1/1976 | Potucek et al. | 29/431 |
| 4,014,225 | | 3/1977 | Lejdegard et al. . | |
| 4,062,389 | * | 12/1977 | Lejdegard | 144/32 |
| 4,287,923 | | 9/1981 | Hornung . | |
| 4,404,877 | | 9/1983 | Mizuno et al. . | |
| 4,517,863 | | 5/1985 | Ishikawa . | |
| 4,619,393 | * | 10/1986 | Maurer . | |
| 4,674,367 | | 6/1987 | Aab et al. . | |
| 4,753,142 | | 6/1988 | Hornung . | |
| 4,784,026 | | 11/1988 | Kobayashi et al. . | |
| 5,012,708 | | 5/1991 | Martindell . | |
| 5,027,679 | | 7/1991 | Kawashima et al. . | |
| 5,101,697 | | 4/1992 | Fishback . | |
| 5,109,738 | | 5/1992 | Farian et al. . | |
| 5,138,913 | | 8/1992 | Chen . | |
| 5,144,870 | * | 9/1992 | Nick | 81/434 |
| 5,186,085 | | 2/1993 | Monacelli . | |
| 5,224,803 | * | 7/1993 | Lallier . | |
| 5,231,900 | | 8/1993 | Deri . | |
| 5,408,903 | | 4/1995 | Ramin . | |
| 5,473,965 | | 12/1995 | Chen . | |
| 5,531,142 | | 7/1996 | Adamo . | |
| 5,531,143 | | 7/1996 | Habermehl et al. . | |
| 5,568,753 | * | 10/1996 | Habermehl et al. | 81/434 |
| 5,584,221 | | 12/1996 | Petrantoni . | |
| 5,931,366 | * | 8/1999 | Muro | 227/137 |

FOREIGN PATENT DOCUMENTS

| | | | | |
|---|---|---|---|---|
| 4208715 | * | 9/1992 | (DE) | B25B/21/00 |
| 778 108 | * | 6/1997 | (EP) . | |
| 93/06320 | * | 4/1993 | (GB) . | |
| 53-37968 | | 4/1978 | (JP) . | |
| 7-256564 | * | 10/1995 | (JP) . | |
| 95/29794 | | 11/1995 | (WO) . | |

* cited by examiner

POWER-OPERATED SCREWDRIVING DEVICE

This application claims the benefit of U.S. Provisional No. 60/058,865 filed Sep. 12, 1997.

When driving screws into workpiece, it is often desirable to adjust the depth of the screwheads relative to the workpiece surface. For example, in some situations one may desire to drive the head below the surface of the workpiece, fill the resulting recess with putty, and then paint over the workpiece surface, thereby providing an enhanced appearance free from visible screwheads. Other times, it desirable to leave screw heads slightly raised during the initial driving. Then, one can go back and fully tighten all of the screws at once.

U.S. Pat. No. 5,568,753 presents one solution to meet this desire. The '753 patent discloses a depth setting member rotatably secured to the housing by a pin aligned parallel to the screwing axis. The depth setting member has a forwardly facing helical surface. A rod extending rearwardly from the front end of the tool engages the depth setting member to thereby limit the relative movement relative driving motion of the bit. One of the problems with such an arrangement is that the entire depth setting assembly is exposed outside of the housing. Thus, the assembly can be accidentally moved out of place rather easily, thereby causing the operator to drive the screw to an inappropriate depth.

Therefore, it is an object of the present invention to provide a screwdriving device with a depth setting feature which is easy to operate, yet difficult to accidentally move out of position. In accordance with the principles of the present invention, there is provided a power-operated screwdriving device configured to be used with a rotary power source and a supply of screws releasably mounted on a collation. The screwdriving device comprises a housing structure constructed and arranged to be engaged with the rotary power source. A feeding assembly defines a drive track carried by the housing and provides a workpiece engaging surface. The drive track is configured to receive a lead screw from the supply of screws.

A rotatable screw engaging bit member is constructed and arranged to be operatively connected to the rotary power source such that the rotary power source rotates the screw engaging bit member during a screwdriving operation wherein the workpiece engaging surface is engaged with a surface of a workpiece and the lead screw is driven into the workpiece. The rotatable screw engaging bit member is movable relative to the drive track and the workpiece engaging surface such that, when the workpiece engaging surface is engaged with the surface of the workpiece, rotation of the bit member and relative movement between the bit member and the drive track drives the lead screw into the workpiece during the screwdriving operation.

Screw depth setting structure provides a feeding assembly engaging surface. The screw depth setting structure is positioned and configured such that the feeding assembly engaging surface engages the feeding assembly to thereby limit the relative movement occurring between the screw engaging bit member and the workpiece engaging surface during the screwdriving operation. The workpiece engaging surface and the rotatable screw engaging bit member are constructed and arranged such that, when the feeding assembly is engaged with the feeding assembly engaging surface, a distance between a screw engaging end portion of the bit member and the workpiece engaging surface determines the depth to which the lead screw will be driven relative to the surface of the workpiece during the screwdriving operation.

A manually engageable screw depth adjusting member is disposed exteriorly of the housing structure and operatively connected to the screw depth setting structure. The screw depth adjusting member is constructed and arranged such that manual operation thereof moves the screw depth setting structure through a range of adjustable positions to thereby adjust the depth to which the lead screw will be driven to the surface of the workpiece during the screwdriving operation.

In addition, in order to effectively drive screws of varying lengths, it is advantageous to be able to adjust the position of the workpiece engaging surface relative to the end of the screw in order to accommodate different screw lengths. In particular, it is desirable to minimize the distance between the penetrating end of the screw and the workpiece so as to prevent movement of the screw before engagement with the workpiece. U.S. Pat. No. 5,473,965 illustrates an adjustable nosepiece assembly for such a purpose. However, the nosepiece is adjusted by unscrewing a threaded member, adjusting the nosepiece, and then retightening the threaded member. The small screw can be difficult to rotate when a user's hands are wet or greasy, thus making adjustment difficult to achieve.

It is therefore an object of the present invention to provide a screwdriving device which has a workpiece contacting structure which is easily and quickly adjusted for accommodating screws of varying lengths. In accordance with another aspect of the present invention, there is provided a power-operated screwdriving device configured to be used with a rotary power source and a supply of screws releasably mounted on a collation. The screwdriving device comprises a housing structure constructed and arranged to be engaged with the rotary power source. A feeding assembly defines a drive track constructed and arranged to receive a lead screw from the supply of screws. A rotatable screw engaging bit member is constructed and arranged to be operatively connected to the rotary power source such that the rotary power source rotates the bit member during a screwdriving operation wherein the workpiece engaging surface is engaged with a surface of a workpiece and the lead screw is driven into the workpiece.

The feeding assembly including a body and an adjustable workpiece contacting structure mounted on the body. The workpiece contacting structure provides a workpiece engaging surface. The workpiece contacting structure is constructed and arranged to be moved relative to the body through a range of adjustable positions to enable the workpiece contacting structure to be positioned in accordance with a length of the lead screw proximal a penetrating end of the lead screw to thereby minimize a distance between the penetrating end and the surface of the workpiece prior to driving the lead screw into the workpiece. A contacting structure locking structure is movable rectilinearly between (1) a locking position wherein the locking structure engages the workpiece contacting structure to thereby limit movement of the workpiece contacting structure relative to the body within the range of adjustable positions and (2) an unlocked position wherein the locking structure is unlocked from the workpiece contacting structure to thereby allow the workpiece contacting structure to be moved through the range of adjustable positions. The rotatable screw engaging bit member is movable relative to the drive track and the workpiece engaging surface such that, when the workpiece engaging surface is engaged with the surface of the workpiece, rotation of the screw engaging bit member and relative movement between the screw engaging bit member and the drive track drives the lead screw into the workpiece during the screwdriving operation.

Furthermore, another problem that can arise in collated screwdriving devices is that the collation and lead screw is allowed to move within the drive track as the bit member engages the screw. Therefore, in order to resolve this problem, another aspect of the present invention provides a power-operated screwdriving device configured to be used with a rotary power source and a supply of screws releasably mounted on a collation. The screwdriving device comprises a housing structure constructed and arranged to be engaged with the rotary power source. A feeding assembly defines a drive track constructed and arranged to receive a lead screw from the supply of screws. A rotatable screw engaging bit member is constructed and arranged to be operatively connected to the rotary power source such that the rotary power source rotates the bit member during a screwdriving operation wherein the workpiece engaging surface is engaged with a surface of a workpiece and the lead screw is driven into the workpiece.

The feeding assembly includes a body and an adjustable workpiece contacting structure mounted on the body. The workpiece contacting structure provides a workpiece engaging surface and a subsequent lead screw engaging surface opposite the workpiece engaging surface. The workpiece contacting structure is constructed and arranged to be moved relative to the body through a range of adjustable positions to enable the workpiece contacting structure to be positioned in accordance with a length of the lead screw wherein force applied to the device towards the workpiece when the workpiece engaging surface is engaged with the workpiece will cause limited relative movement between the contacting structure and the body until the subsequent lead screw engaging surface contacts a penetrating end of the subsequent lead screw so as to terminate relative movement between the workpiece contacting structure and the body so as to hold the supply of collated screws as the lead screw is being driven into the workpiece.

A contacting structure locking structure is movable between (1) a locking position wherein the locking structure engages the workpiece contacting structure to thereby limit movement of the workpiece contacting structure relative to the body within the range of adjustable positions and (2) an unlocked position wherein the locking structure is unlocked from the workpiece contacting structure to thereby allow the workpiece contacting structure to be moved through the range of adjustable positions. The rotatable screw engaging bit member is movable relative to the drive track and the workpiece engaging surface such that, when the workpiece engaging surface is engaged with the surface of the workpiece, rotation of the screw engaging bit member and relative movement between the screw engaging bit member and the drive track drives the lead screw into the workpiece during the screwdriving operation.

Other objects, advantages, and features of the present invention will become apparent from the following detailed description, the accompanying drawings, and the appended claims.

DETAILED DESCRIPTION OF THE DRAWINGS

Figure 1:
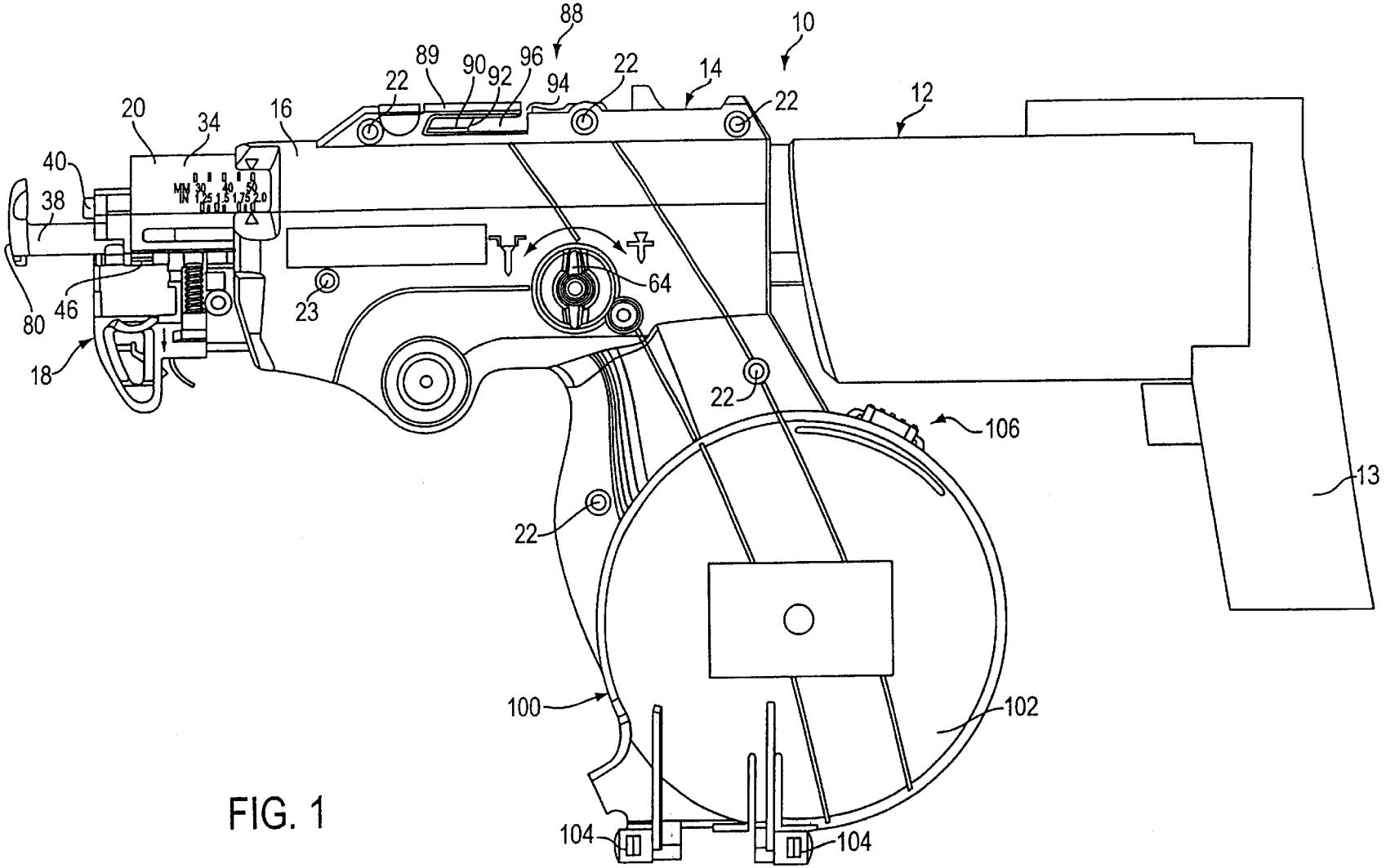
FIG. 1 is a side profile view of a screwdriving device constructed in accordance with the principles of the present invention and connected to a ro

FIG. 1 is a side plan view of a coil fed screw system, generally indicated at 10, constructed in accordance with the principles of the present invention. The screw system 10 includes a conventional screw gun 12, such as Model DW257 manufactured by DeWalt of Hampstead, Md., and is more particularly concerned with a screwdriving device 14 manufactured in accordance with the present invention. The screw gun 12 serves as a rotary power source and supplies rotational power to drive screws into a workpiece during a screwdriving operation. The screwdriving device 14 includes a molded plastic housing structure 16 and a feeding assembly 18. The feeding assembly 18 comprises a body 110 and a workpiece contacting structure 20, both of which are received within the housing structure 16.

Figure 2A:
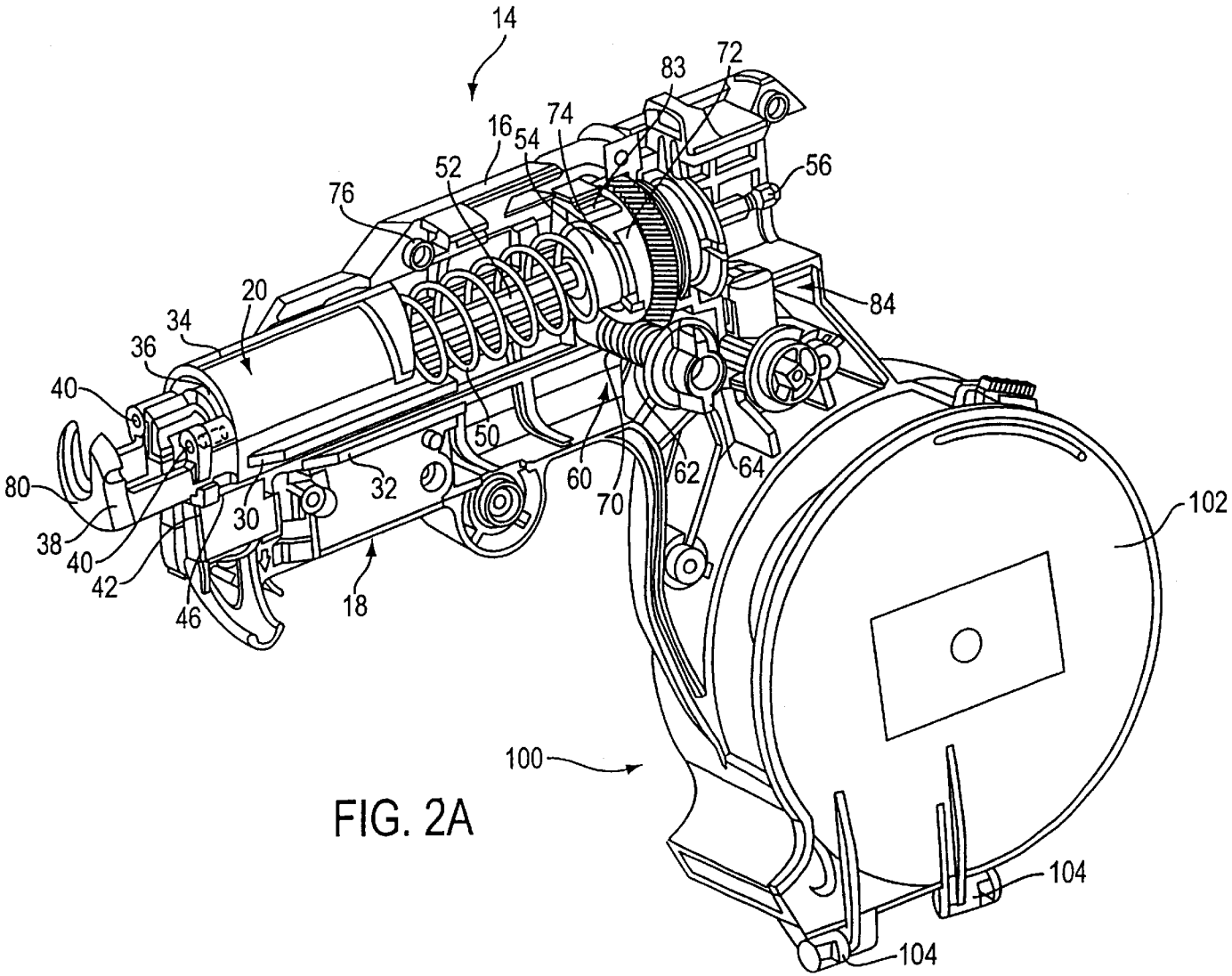
FIG. 2A is a lower front perspective view of the device of FIG. 1 with one housing half removed.
Figure 2B:
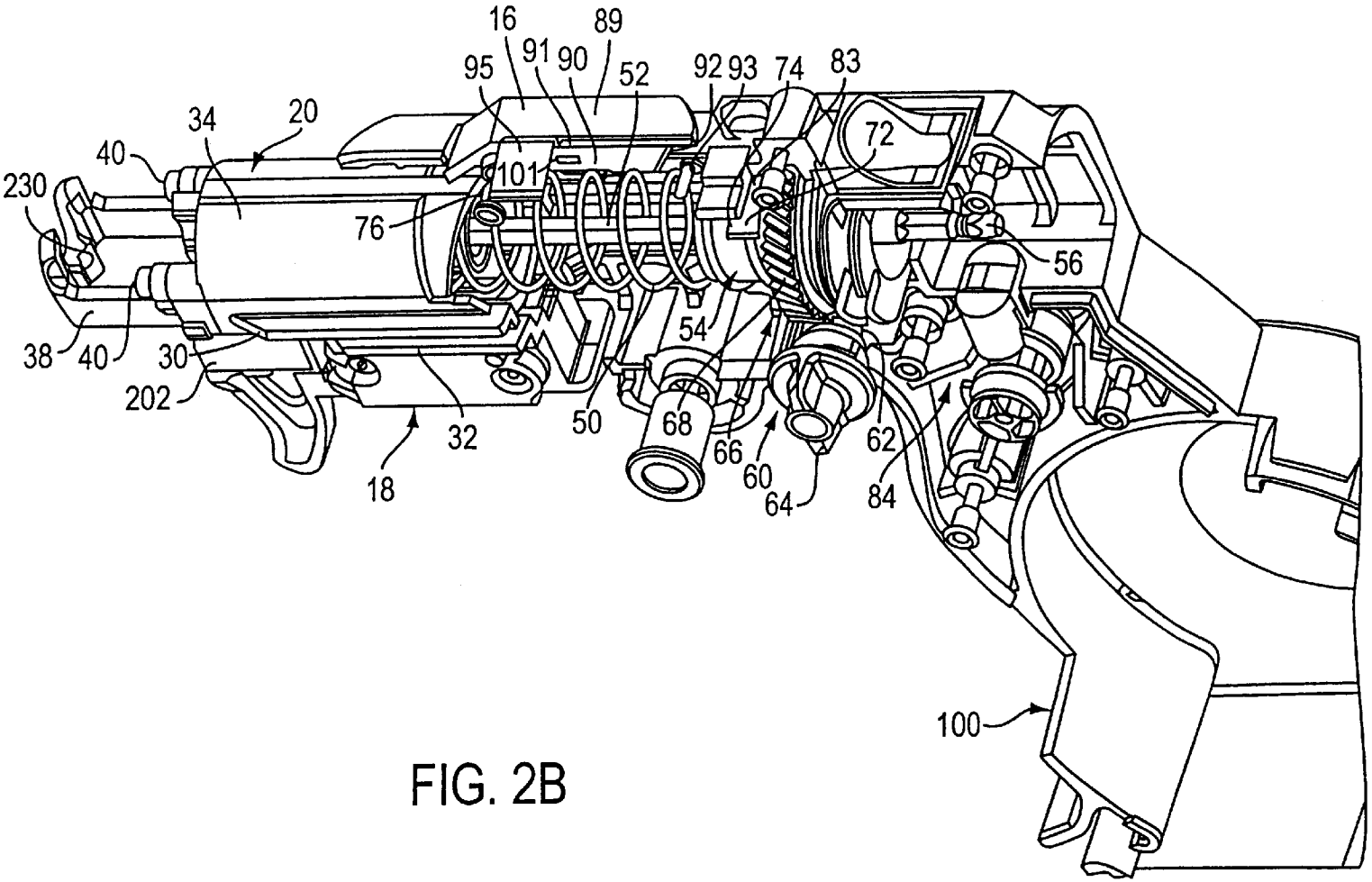
FIG. 2B is an upper rear perspective view of the device of FIG. 1 with the one housing half removed and the magazine assembly opened.
Figure 2C:
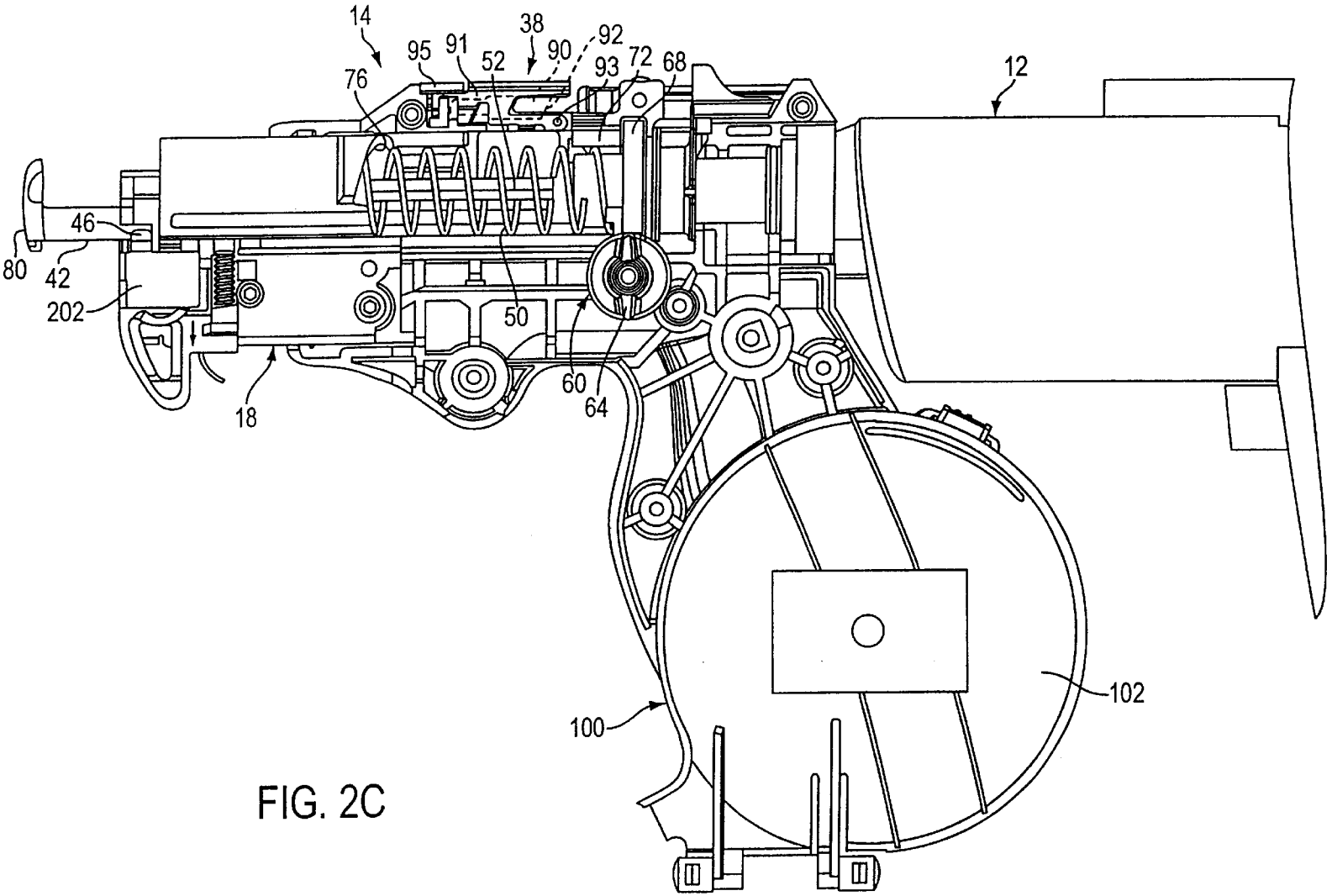
FIG. 2C is a side profile view of the device of FIG. 1 with the one housing half removed.
Figure 2D:
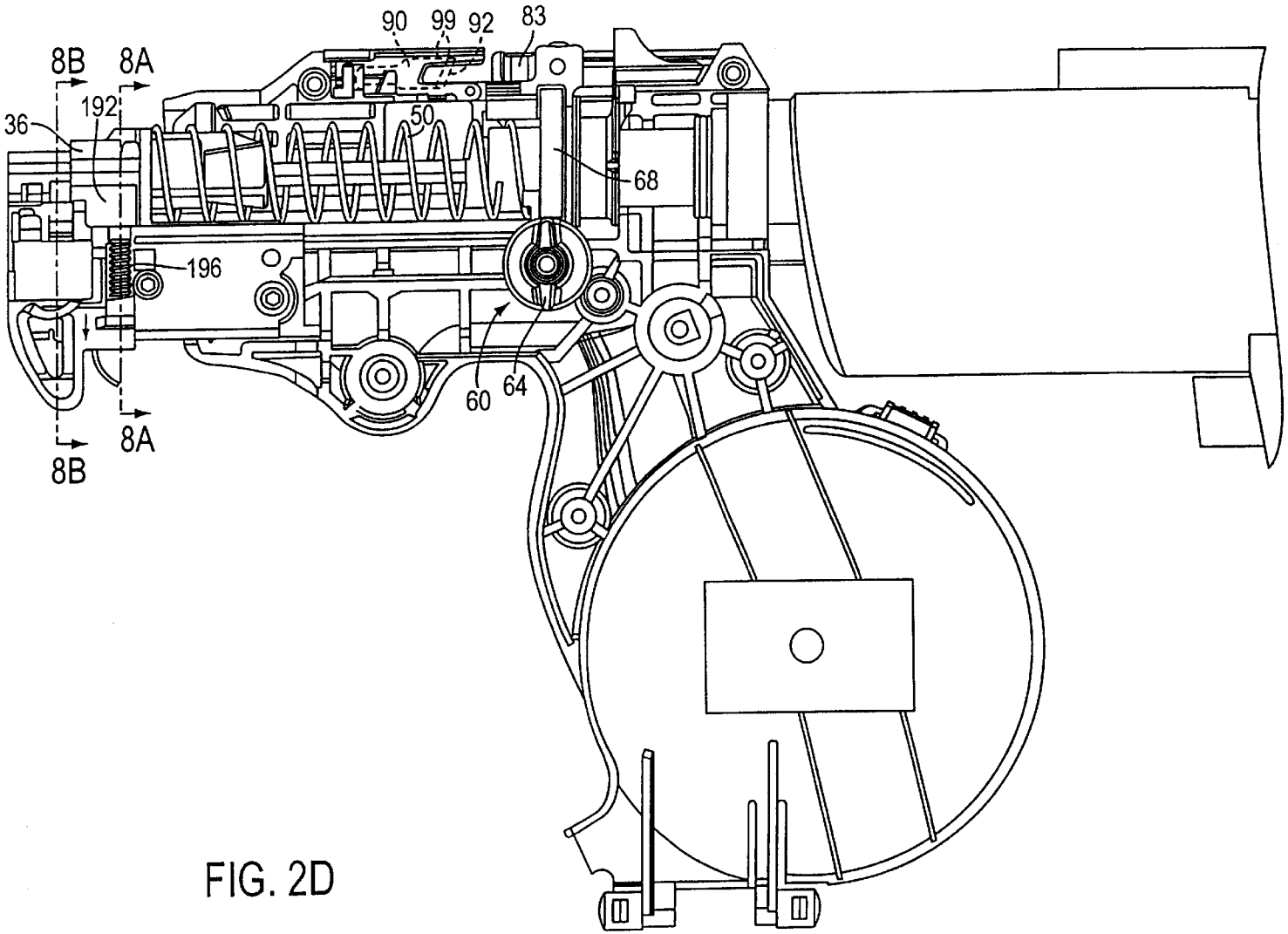
FIG. 2D is a side profile view of the device of FIG. 1 with the one housing half removed and the workpiece contacting structure removed from the feeding assembly.

The housing structure 16 comprises two (2) clam shell halves which are secured to one another by a plurality of fasteners 22. FIGS. 2A and 2B are perspective views and FIG. 2C is a side plan view of the screwdriving device 14 with one of the clam shell halves of the housing structure 16 removed. FIG. 2D is similar to FIG. 2C, but has the workpiece contacting structure 20 removed. As can be appreciated from FIGS. 3A and 3B which show both the inside and outside of the clam shell half illustrated in FIGS. 2A–2D, each clam shell half of the housing structure 16 has a pair of vertically spaced, longitudinally extending grooves 24 and 26. Referring back to FIGS. 2A–2D, it can be appreciated that grooves 24 provided on both clam shell halves are constructed and arranged to receive laterally outwardly extending ridges 30 provided on opposite sides of the workpiece contacting structure 20. Similarly, the grooves 26 in the opposite clam shell halves of the housing structure 16 are constructed and arranged to receive laterally extending ridges 32, which extend laterally outwardly from opposite sides of the body 110 of the feeding assembly 18. The cooperation of ridges 30 and 32 with respective grooves 24 and 26 guide the longitudinal movement of the feeding assembly 18 along the screwing axis.

The workpiece contacting structure 20 has a main half-shell portion 34 placed over a cylindrical bit receiving portion 36 of the body 110, and a forwardly extending nose extension portion 38 fixed to the main half-shell portion 34 by a pair of fasteners 40.

It should be appreciated that the relative axial position of the workpiece contacting structure 20 with respect to the body 110 is determined by the inter-engagement of a plurality of longitudinally extending teeth 42 provided on the lower portion of nose extension 38 (see bottom plan view in FIG. 17) and teeth 44 provided on a locking projection 46 of the body 110. This inter-engagement of teeth 42 and 44 will be described in greater detail later. A coil spring 50 biases the feeding assembly 18, and thus also the workpiece contacting structure 20 by virtue of the inter-engagement of teeth 44 and 42, forwardly within housing structure 16 relative to the bit member 52.

Extending along the screwing axis, and through the spring 50 and bit receiving portion 36 of the feeding assembly 18 is an elongated, rotatable screw engaging bit member 52 which is operatively connected by a bit locking assembly 54 to a rearwardly extending, elongated mandrel 56. The distal end of the mandrel 56 is constructed and arranged to be connected with the output of the screw gun 12 (i.e. the rotary power source) such that the screw gun can rotate the bit member 52 along the screwing axis during a screwdriving operation. Thus, the mandrel 56, which is clamped to the rotating output of screw gun 12, serves as the input for rotation of the bit member 52.

The screwdriving device 14 further comprises a screw depth adjustment assembly 60 which is constructed and arranged to adjust the depth to which the screw is screwed relative to the surface of a workpiece. The screw depth adjustment assembly 60 includes a motion transmitting structure 62 in the form of a plastic worm gear and a manually adjustable screw depth adjusting member 64. The screw depth adjustment assembly 60 further includes a plastic screw depth setting structure 66 having teeth 68 which releasably intermesh with teeth 70 of the motion transmitting structure 62. The screw depth setting structure 66 further includes an integrally formed cam structure 72 having a forwardly facing feeding assembly engaging surface 74 with a helical configuration. The forwardly facing feeding assembly engaging surface 74 is constructed and arranged to engage with rearwardly facing cam member engaging surface 76 provided on the rearward edge of the main shell portion 34 of the workpiece contacting structure 20. The orientation or position of the feeding assembly engaging surface 74 can be altered by manual rotation of the manually engageable member 64. The position or orientation of the feeding assembly engaging surface 74 determines the possible extent of rearward movement of the workpiece contacting structure 20, and thus the feeding assembly 18, relative to the bit member 52 and housing structure 16 during a screwdriving operation. More specifically, as will be described in greater detail, when a screw is screwed into a workpiece, the feeding assembly 18 rides rearwardly within housing structure 16 until the cam member engaging surface 76 of the feeding assembly 20 engages the feeding assembly engaging surface 74 of the screw depth setting structure 66. The extent of rearward movement of the workpiece contacting structure 20 and feeding assembly 18 will be determined by the position of the engaging surface 74 relative to the engaging surface 76, so as to determine the depth to which a screw can be screwed into a workpiece. This is due to the fact that when the cam member engaging surface 76 is engaged with the feeding assembly engaging surface 74, the position of a forwardmost workpiece engaging surface 80 of the nose extension portion 38 relative to the position of the forwardmost screw engaging end 81 of bit member 52 will determine the depth to which a screw can be screwed into a workpiece. The further back that work piece engaging surface 80 moves relative to the forward end 81 of the bit member 52, the deeper the lead screw will be deeper into the workpiece. Thus, when surface 80 is moved rearwardly past the screw engaging end 81 at the end of a full screwdriving stroke, the forward screw engaging end 81 of the bit member 52 extends beyond the workpiece engaging surface 80 to force the screw into a workpiece, thereby causing the screw to be driven below the surface of the workpiece. Likewise, when the workpiece engaging surface 80 is moved rearwardly, but does not reach the screw engaging end 81 of the bit member 52 at the end of a full screwdriving stroke, the screw will be driven into the workpiece and the head of the screw will be raised relative to the surface of the workpiece. Thus, when the engaging surfaces 74, 76 are engaged with one another, the distance between the end portion 81 and the bit member 52 and the workpiece engaging surface 80 determines the depth to which the lead screw will be driven.

The screw depth setting structure 66 is preferably made from a colored (most preferably red) plastic material to enable the cam structure 72 to be readily visible through an opening or window 83 provided in the upper wall portion of the housing structure 16 (see FIG. 2B). The cam structure 72 is oriented beneath the window such that it will be visible, with the helical feeding assembly engaging surface 74 appearing in the window. The cam structure 72 will be oriented to visibly occupy more of the window as the screw depth adjustment is set to be less deep, and to visibly occupy less of the window as the depth adjustment is made deeper, so as to provide the user with a relative indication of the screw depth setting. Stated differently, the distance between the end portion 81 of the bit member 52 and the workpiece engaging surface is related to an amount of viewing area in the viewing window occupied by the depth setting structure 66, thereby allowing the operator to visually determine the depth to which the lead screw will be driven.

The screwdriving device 14 further includes a manually releasable locking mechanism 84 constructed and arranged to lock the screwdriving device 14 to the rotary power source 12. The locking mechanism 84 provides a locking connection which removes any jiggle or play between the screwdriving device 14 and the power soure 12, and will be described in greater detail later.

Figure 19:
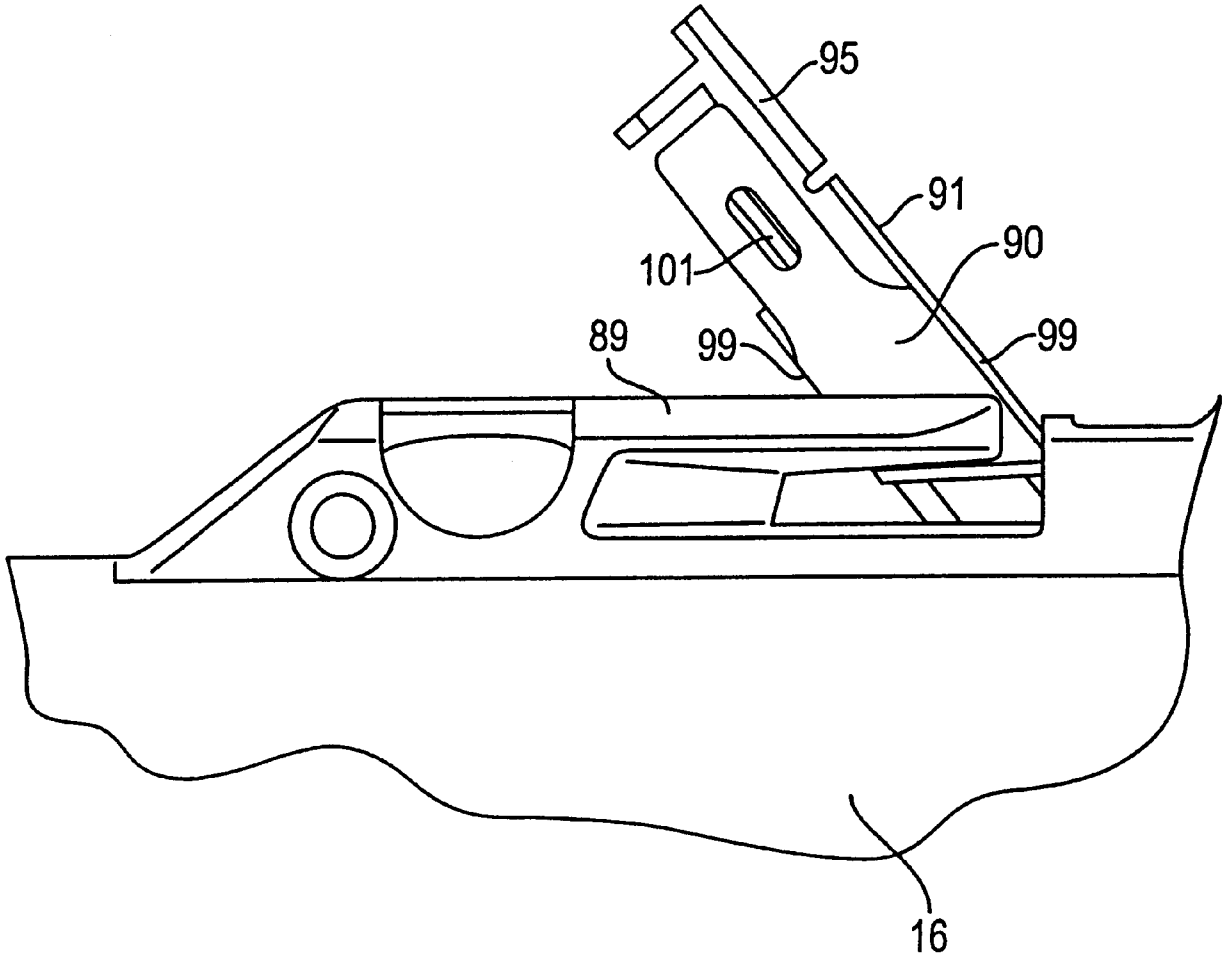
FIG. 19 shows the cutting structure in a position for replacement.

The housing structure 16, as shown in FIG. 1, mounts a collation cutting structure 88 for cutting used collation portions which have been ejected from the drive track subsequent to a screwing operation. The cutting structure 88 includes a sharp metal blade member 90, the cutting edge 92 of which can be accessed by manually moving the collation through an outwardly facing opening 94 and into a collation receiving slot 96 in the housing structure 16. A blade shielding structure 89 of the housing structure 16 serves to define the opening 94 and the collation receiving slot 96 and to insulate or shield the edge 92 of the cutting blade 90 from accidental manual contact. The blade 90 is removably fixed on a metal blade mounting structure 91 as shown in FIG. 2C. In FIG. 2C, the blade 90 is shown in dashed lines so as to more clearly illustrate mounting structure 91. As can be appreciated from FIGS. 2B and 2C, the mounting structure 91 is pivotally mounted to the housing structure 16 by hinge member 93, and has a manually engageable portion 95 which can be manually engaged and lifted to the position shown in FIG. 19. To replace the cutting blade 90, the manually engageable portion 95 is lifted to pivot the blade mounting structure 91 about hinge member 93 to a replacement position to gain access to the blade 90 for replacement thereof. In particular, the blade shielding structure 89 of housing structure 16 defines a narrow longitudinal blade receiving slot 97 through which the blade mounting portion of mounting structure 91 can be moved during pivoting movement thereof The blade 90 has upper and lower non-cutting edges 99 received in upper and lower grooves in the mounting structure 91. In addition, the mounting structure 91 has a laterally extending blade attaching projection 101 for projecting through a blade attaching hole in the blade 90. To replace the blade 90 after the mounting structure is pivoted so that it extends above the blade shielding structure 89 of housing structure 16, the blade 90 is pulled outwardly away from mounting structure 91 so that the hole therethrough is removed from the projection 101. The blade 90 can then be slid off the mounting structure 91.

As shown in FIG. 1, the housing structure 16 provides a drum-shaped magazine assembly 100 having an interior for containing a supply of coiled and collated screws having heads adapted to receive a squared or shaped bit end. The magazine assembly 100 has a generally circular loading opening covered by a generally circular closure structure 102 pivotally mounted at hinged connections 104 for movement between (1) an open position wherein access to the interior of the magazine through the loading opening is permitted and (2) a closed position wherein access to the interior through the leading opening is prevented and the supply of screws is prevented from exiting the magazine assembly through the loading opening. Closure structure 102 has an integrally formed latching arrangement 106 for latching the closure structure 102 to the assembly 100. The latching arrangement comprises a flexible projection integrally molded with the closure structure 102. The flexible projection can be received in a hole molded in the wall of the magazine assembly 100 to lock the closure structure in covering relation to the magazine interior. The flexible projection has a manually engageable portion that can be manually depressed to move the projection out of the hole and unlock the closure structure 102. The magazine assembly 100 is substantially hollow, and has no central inner diameter structure which would take up interior space of the magazine assembly 100.

Figure 4:
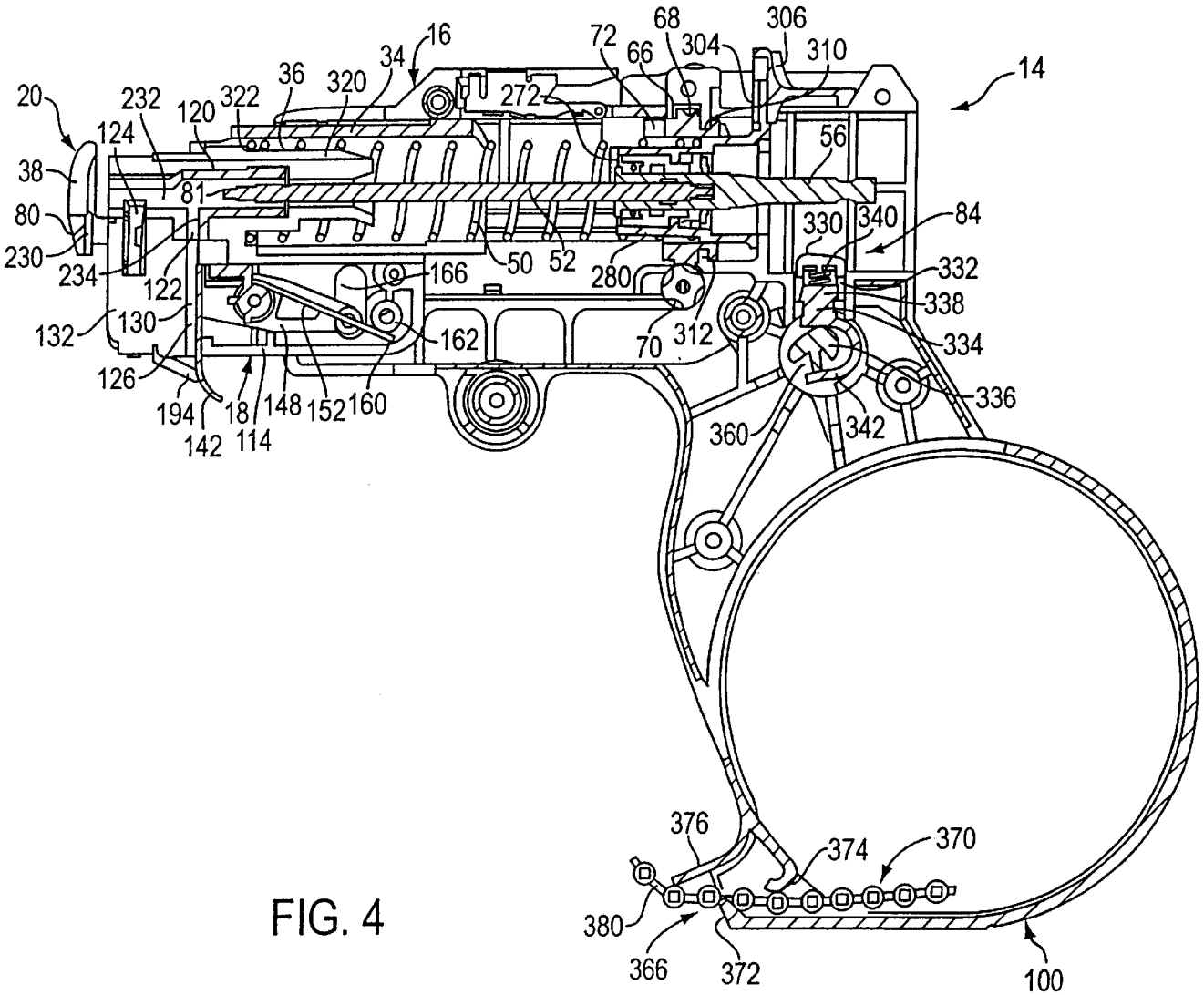
FIG. 4 is a cross-sectional view of the device of FIG. 1 taken along its longitudinal axis.

FIG. 4 is a longitudinal sectional view of the screwdriving device 14 in accordance with the present invention. As shown, the forward end portion of the bit member 52 is received within the cylindrical bit receiving portion 36.

Figure 5:
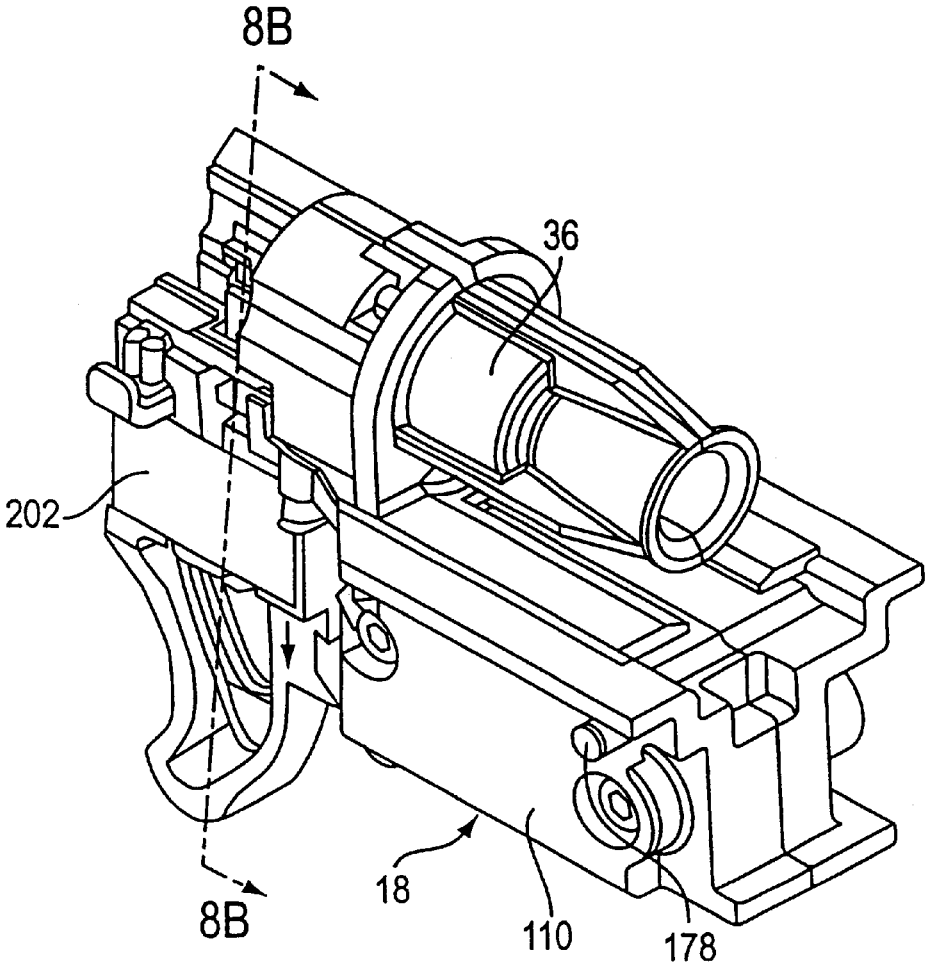
FIG. 5 is an upper rear perspective view of the body of the feeding assembly.
Figure 6:
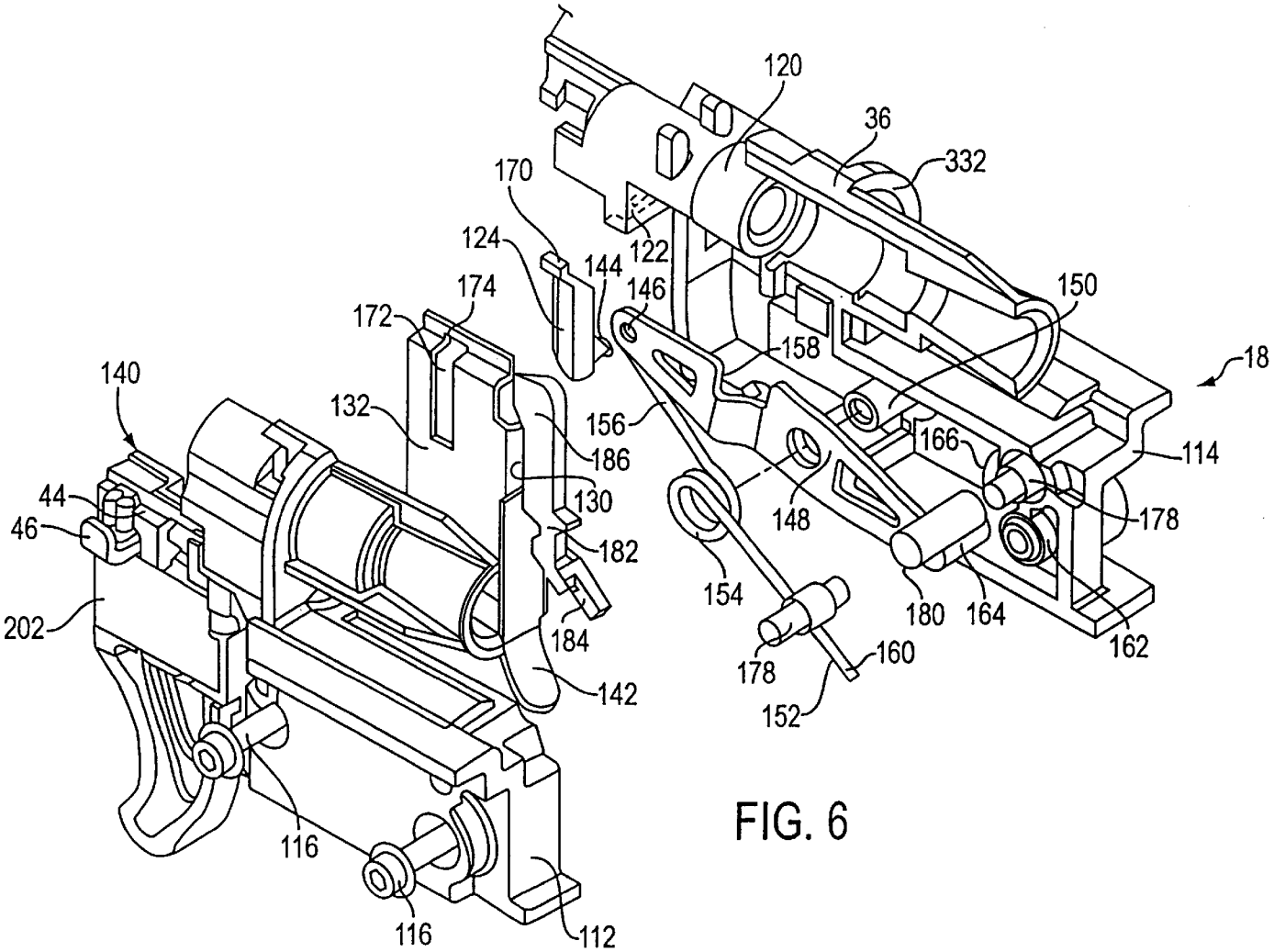
FIG. 6 is an exploded view of the body of the feeding assembly.
Figure 8B:
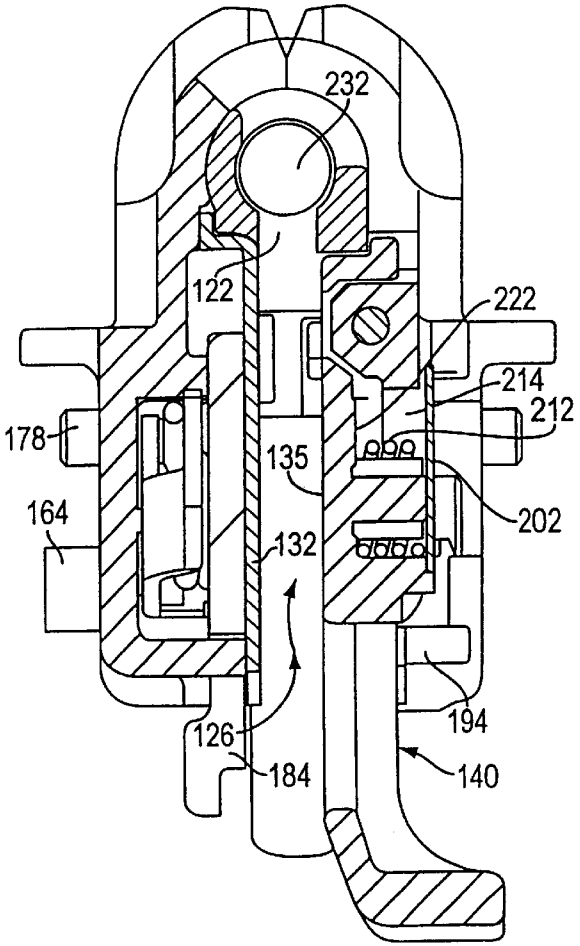
FIG. 8B is a cross-sectional view taken along lines 8B—8B of FIG. 2D.

FIG. 5 is a perspective view of the feeding assembly 18 and illustrates the cylindrical bit receiving portion 36 thereof more clearly. FIG. 6 is an exploded view of the feeding assembly 18 and illustrates that the cylindrical bit receiving portion 36 is formed as part of the body 110 and that the body 110 comprises two (2) housing halves 112 and 114 secured to one another by suitable fasteners 116. As can be appreciated from FIGS. 4 and 6, the outer cylindrical bit receiving portion carries a tubular drive bushing 120. The forward portion of the drive bushing 120 defines a vertically extending slot 122 constructed and arranged to receive an upwardly directed head of a screw. More particularly, and as will be described later in greater detail, a forwardly pointed lead screw is directed upwardly by a screw engaging portion 170 of a screw feeding structure 124 in the form of a pawl, as the head of the screw travels upwardly through a track 126 defined by opposing grooves, including a first groove 130 provided in a cover member 132 and an opposing groove 134 (see FIG. 17 and 8B) provided on an interior surface 135 of a door structure 140. The screw receiving track 126 is further defined by a screw guide member 142 integrally formed with a cover member 132. The track 126 extends upwardly so that the head of a fastener is received within the groove or slot 122 in the bushing 120.

As shown in FIG. 6, the aforementioned screw feeding structure 124 has a laterally extending projection 144 that extends inwardly through an opening 146 in a pivoting lever member 148. The lever member 148 is pivotally mounted on a tubular mounting pin 150 having internal threads for receiving one of the fasteners 116. A biasing element in the form of torsion spring 152 has the coil portion 154 thereof received over the pin 150 after the lever 148 is received over the pin 150. A first end portion 156 of the torsion spring 152 extends through a notch 158 in the lever member 148 so as to engage the underside of projection 144 after it has passed through the opening 146 in the lever member 148. The first portion 156 biases the screw feeding structure 124 upwardly towards a lead screw engaged position and biases the lever member 148 for counterclockwise rotation about pin 150 as viewed in FIG. 6. The second end portion 160 of the torsion spring 152 opposite the first end portion 156 is disposed beneath a rigid stop structure 162 (see FIG. 4) to enable the upwardly biasing force of first end portion 156.

The lever member 148 has outwardly extending projection 164 at the rearward end thereof. The projection 164 extends through a vertical slot 156 provided in the side wall of housing half 114 of the body 110 (see FIG. 4) so as to be projecting laterally outwardly from the housing half 114 when feeding assembly 18 is assembled. It should be appreciated that when the projection 164 is forced to ride upwardly within slot 166, screw feeding structure 124 is forced downwardly against the upward biasing force of biasing 152 towards a successive lead screw engaged position. When assembled, a screw engaging portion 170 of the screw feeding structure 124 extends through an opening 172 in the cover member 132. The screw engaging portion 170 can be pushed inwardly to a lead screw disengaged position so as to pivot about the projection 144 until the portion 170 engages a top edge 174 of the opening 172. More particularly, the upward bias of the first end portion 156 of torsion spring 152 against the projection 144 tends to bias the screw feeding structure 124 so that it has a tendency to pivot about the projection 144 in a direction which forces the screw engaging portion 170 outwardly through the opening 172 towards the collation and the screws and, thus, either the lead screw or successive lead screw engaged positions. This outward bias of the screw feeding structure 124 can be overcome by pushing the screw engaging portion 170 back towards the direction of the opening 172 in the cover member 132. It can be appreciated that during operation of the tool, downward movement of the screw feeding structure 124 results in the convex exterior surface of the screw engaging portion 170 engaging and riding over the side of a successive lead screw, and that subsequent upward movement of the screw feeding structure 124 under the upward biasing force of torsion spring 152 will cause the screw engaging portion 170 move from the successive lead screw engaged position to the lead screw engaged position and to engage the underside of the successive lead screw and force the successive lead screw upwardly in a feeding direction such that the head thereof rides upward through track 126 and into groove 122 so that the head is axially aligned with the end 81 of bit 52 (see FIG. 4).

Referring again to FIGS. 5 and 6, it can be seen that a pair of feeding assembly attachment structures 178 extend laterally outwardly from opposite sides of the feeding assembly 112 and 114. A coil spring 180 biases these attachment structures 178 to project outwardly to enable attachment structures 178 to releasably lock the feeding assembly 18 within the housing structure 16. In particular, attachment structures 178 extend through attachment structure receiving openings 23 (see FIG. 15) on opposite sides of the housing structure 16 to secure the feeding assembly 18 to the housing structure 16. The feeding assembly 18 can be released from housing structure 16 by inserting an elongate member, such as the bit member 52 when released from the mandrel 56, into the each of the holes 23 to push one of the attachment structure 178 inwardly against the bias of spring 180 and out of engagement with the interior surfaces of the holes 23. The feeding assembly 18 can then be pulled forwardly relative to housing structure 16 and removed from housing structure 16 for cleaning and maintenance.

A manually engageable release member 182 is pivotally mounted inside the cover member 132 and has a manually engageable portion 184 thereof that extends outside the cover 132 and is manually engageable to effect counterclockwise rotation of member 182 in FIGS. 4 and 6. This rotation of the release member 182 causes the engaging structure engaging portion 186 thereof to come between the cover member 132 and the upper portion of screw feeding structure 124 so as to cammingly engage and move the screw engaging portion 170 into opening 172 against the bias of torsion spring 152 (the lead screw disengaging position) so as to allow any collated screws disposed above the screw engaging portion 170 to be pulled downwardly out of the screw drive track 232 in a removal direction opposite the feeding direction.

Figure 18:
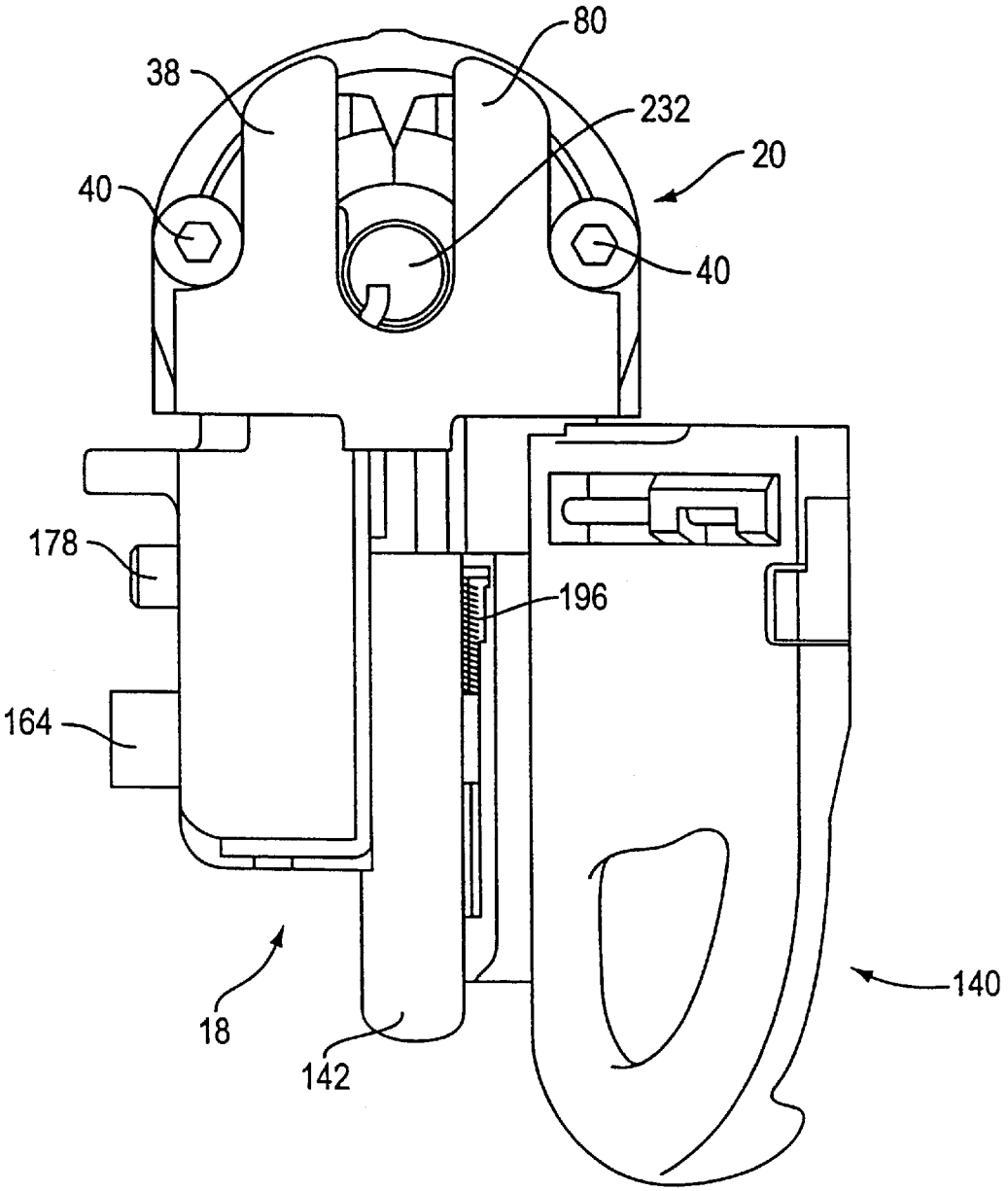
FIG. 18 shows the door structure of the feeding assembly in the open position.

As stated previously, the contacting structure locking projection 146 of the door structure 140 has teeth 44 which engage the teeth 42 of the workpiece contacting structure 20 so as to set the relative position between the body 110 and the workpiece contacting structure 20 for purposes of adjusting the workpiece contacting structure 20 for the screw length to be used. More particularly, referring to FIG. 7, the door assembly 140 is pivotally mounted to the body housing half 112 by a hinge pin 190 fixed at its upper end to body housing portion 192 and extends downwardly therefrom. The pin 190 is slidable in openings provided in a pair of vertically spaced hinged support members 194 forming part of the door assembly, as can be more fully appreciated from FIG. 8A, which is a cross-sectional view taken along the line 8A—8A in FIG. 2D. As can also appreciated from FIGS. 7 and 8A, a coil spring 196 is deposed in surrounding relation to the hinge pin 190 and in between the upper hinge support 194 and a lower hinge pin receiving portion 198 of the housing half 112. The coil spring 196 permits the door assembly 140 to be manually forced downwardly against its biasing force so that the teeth 44 of the door assembly 140 are brought out of engagement with the teeth 42 of the workpiece contacting structure 20. When the door assembly 140 is moved downwardly to an extent that the lower hinge support 194 has the upper surface 195 thereof disposed below the bottom surface 197 of housing half 112, the door assembly is permitted to pivot with respect to hinge pin 190. The door assembly 140 pivots such that it moves out of the page in FIG. 7 as shown in FIG. 18. Such pivotal movement of door assembly 140 permits access to the track 126 and groove formed between the cover 132 and inner surface 135 of the door assembly (see FIG. 8B). This is advantageous in the event of jams.

Disengagement of the teeth 42 with a teeth 44 also permits the workpiece contacting structure 20 to be manually moved longitudinally along groove 24 provided in the housing structure 16 for screw length adjustment. More specifically, the workpiece contacting structure 20 is moved forwardly for larger screws and rearwardly or inwardly relative to the housing structure 16 for smaller screws. As shown in FIG. 1, the nose assembly 20 is provided with screw length indications 200 which can be aligned with an indicator 202 provided on the housing structure 16 for screw length adjustment. After the appropriate screw length adjustment position for the workpiece contacting structure 20 is accomplished, the door assembly 140 can be released so that the spring 196 biases the door upwardly so that the teeth 44 thereof engage the teeth 42 of the contacting structure 18 to set the position of the workpiece contacting structure 18 relative to the door assembly 140.

While the operative position of the workpiece contacting structure 20 relative to the door assembly 140 is determined by the position of engagement between teeth 44 with teeth 42, it should be appreciated that during operation of the tool, slight relative movement between the contacting structure and the feeding assembly 18 is permitted as defined by the relative movement of teeth 44 with respect to the door assembly 140. More particularly, the door assembly 140 has a cover member 202 (see FIG. 8B), which has been removed in FIG. 7. As further shown in FIG. 7, the teeth 44 are integrally formed on projection 46 which extends radially outwardly from a slider body 204.

Figure 7:
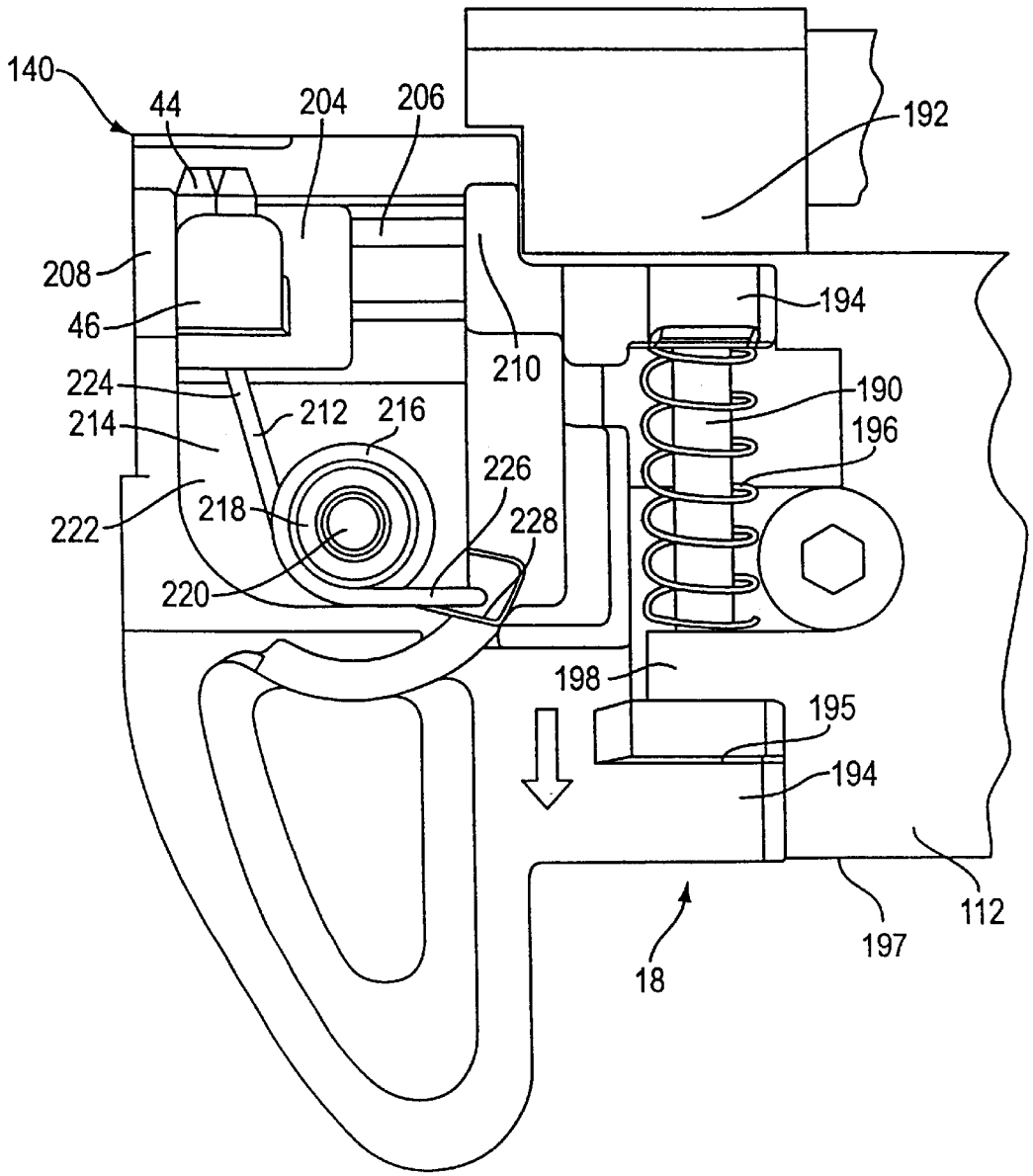
FIG. 7 is a close-up view of the door structure of the feeding assembly.
Figure 8A:
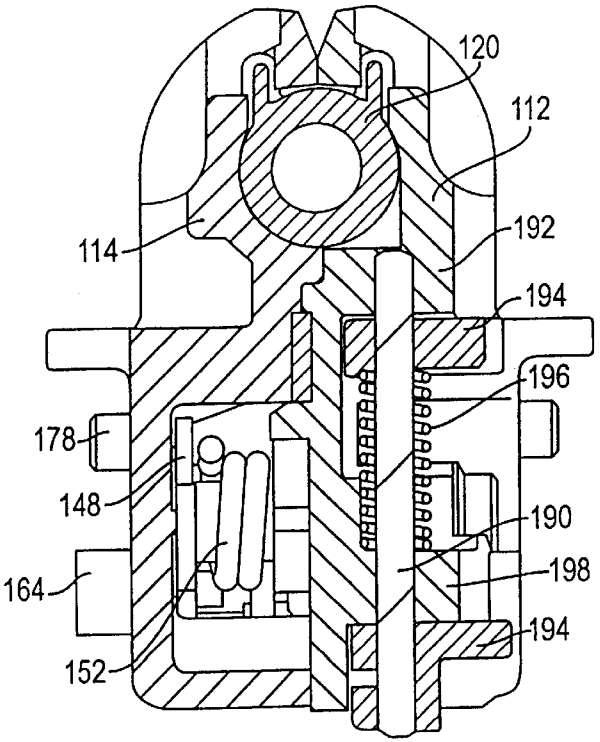
FIG. 8A is a cross-sectional view taken along lines 8A—8A of FIG. 2D.
Figure 9:
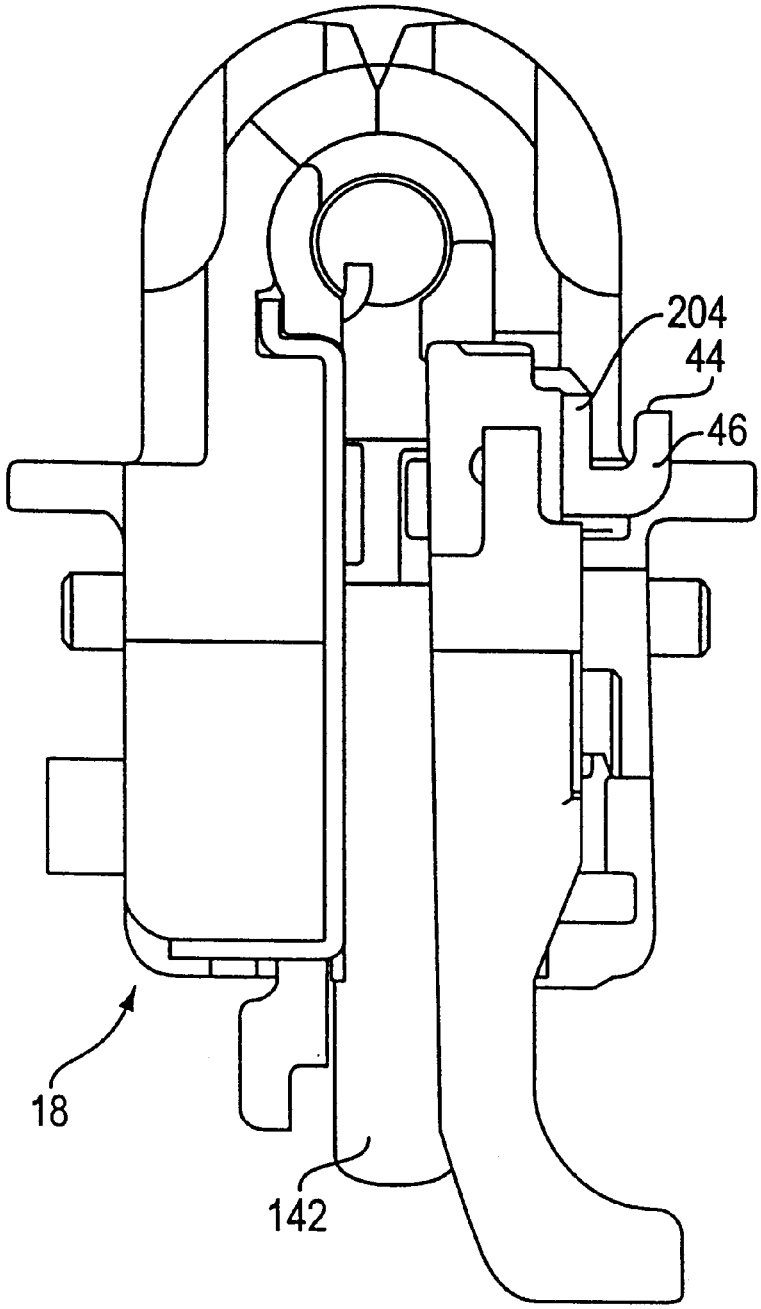
FIG. 9 is a front view of the body of the feeding assembly.

FIG. 9 is a front plan view of the body assembly 18 and illustrates the configuration of the slider body 204 and projection 46 with teeth 44 more clearly. Referring back to FIG. 7, it can be appreciated that the slider body 204 is slidably mounted on a guide post 206, which permits sliding movement of the slider body 204 between opposing stop structures 208 and 210. A torsion spring 212 is provided within a compartment 214 behind the cover 202 of the door assembly 140. The torsion spring 212 has a plurality of coils 216 wrapped around a plastic tubular bushing 218, which in turn is deposed in surrounding relation to a projecting post extending radially outwardly from a rearward or inner wall 222 of a compartment 214. The upper extension of 224 of the torsion spring 212 is received within a slot in the slider body 204, while the lower extension 226 of torsion spring 212 rests upon a bottom surface 228 of the compartment 214. The upper extension 224 of torsion spring 212 biases the slider body 204 forwardly, which in turn biases the entire workpiece contacting structure 20 forwardly relative to the body 110 by virtue of the engagement of teeth 44 of the body 110 with the teeth 42 of the contacting structure 20. The bias of the torsion spring 212 is such that when the tool is at rest, the slider body is disposed as shown in FIG. 7, resting against the forward stop structure 208.

During a screwing operation, it can be appreciated that when the workpiece engaging surface 80 of the contacting structure 20 is forced against a workpiece, the contacting structure 20 is moved rearwardly relative to the body 110 against the bias of torsion spring 212 until a second or subsequent screw 400 disposed beneath the lead screw which is axially aligned with the forward end of bit member 52 (see FIG. 110) is engaged with the inner or subsequent lead screw engaging surface 230 opposite the workpiece engaging surface 80 of the contacting structure 20. More specifically, when the workpiece engaging surface 80 of the structure 20 is engaged with the workpiece, rearward movement of the contacting structure 20 continues until the surface 230 opposite the workpiece engaging surface 80 engages a screw tip of subsequent screw 400 disposed beneath the lead screw within the drive track 232. When a screw 398 to be driven is disposed in the drive track 232 with its head aligned with the forward tip of bit member 52, the subsequent collated screw 400 disposed immediately beneath the lead screw 398 within the drive track 232 has its head disposed within slot 122 of the bushing 120. Thus, when the tip of the subsequent screw 400 is engaged by the rear surface 230 of the contacting structure extension portion 38, continued rearward movement of the contacting structure 20 is imparted through the subsequent screw 400 to the body 110 by virtue of the engagement of the subsequent screw's head with a surface 234 of bushing 120 defining a rear surface of the slot 122. When this force is transmitted from the workpiece contacting or nose extension portion 38 to the body 110 through the second screw in the aforementioned fashion, relative movement of the contacting structure 20 with respect to the body 110 is terminated. Thereafter, further movement of the structure 20 inwardly occurs in conjunction with rearward movement of the body 110 against the force of the coil spring 50 during a screwing operation.

Figure 10:
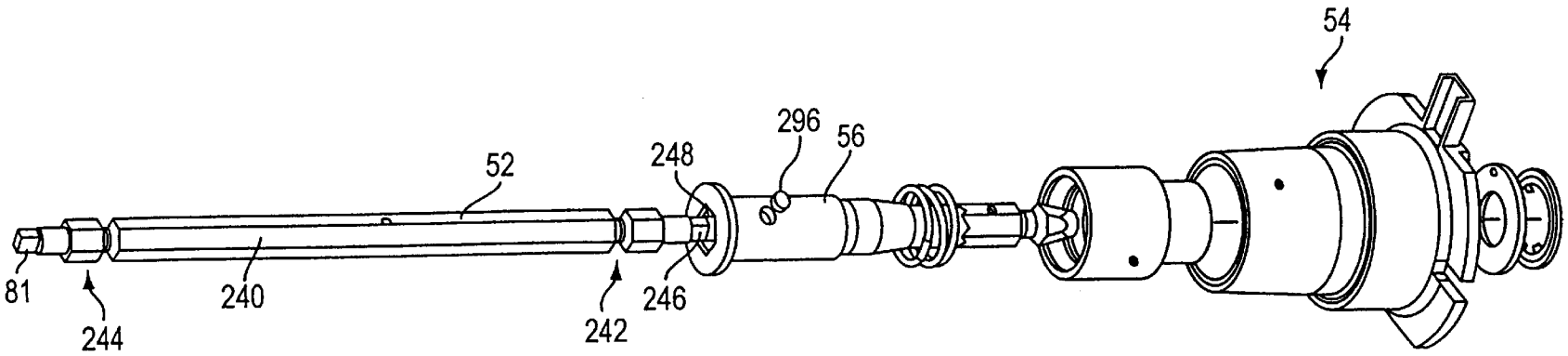
FIG. 10 is an exploded view of a bit member and bit locking assembly.
Figure 11:
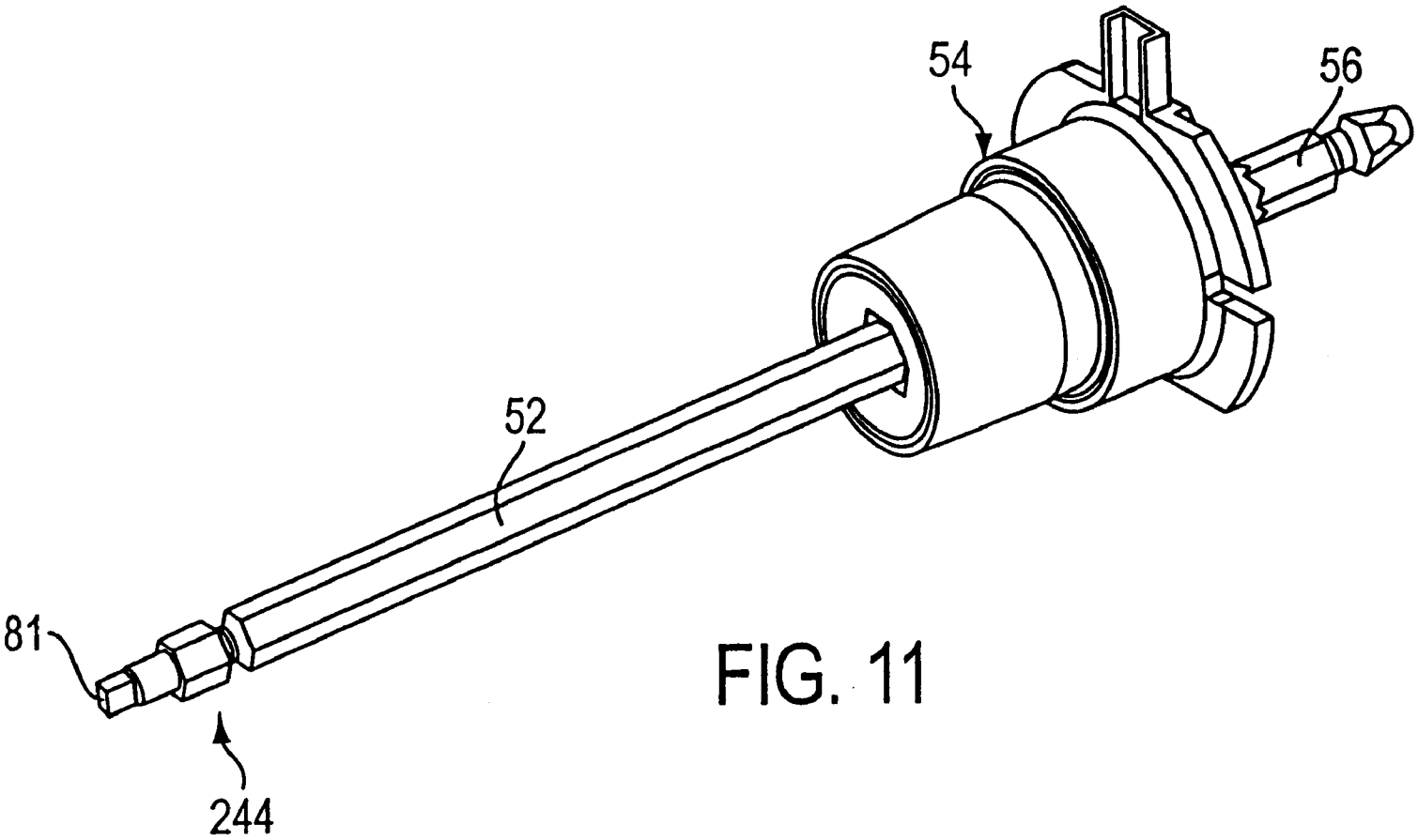
FIG. 11 is a perspective view of the bit member connected to the bit locking assembly.

FIG. 10 is an exploded perspective view and FIG. 11 is an assembled perspective assemble view of the bit 52, releasable bit locking assembly 54, and the mandrel 56 of the present invention.

As shown, the forward end 81 of the bit member 52 has a squared configuration which is constructed and arranged to be received in a square opening in a screw head. The bit member 52 has a hexagonal cross section along an intermediate portion 240 thereof. A rearward portion of the bit member, generally indicated at 242, comprises a connecting portion which enables the bit member 52 to be connected with the mandrel 56. A forward portion, generally indicated at 244, of the bit member 52 is substantially identical in configuration to the rearward connecting portion 242. In addition, a rearward tip or end 246 of the bit member 52 is substantially identical with the forward tip or end 81 and has a squared configuration. As a result, the construction of the bit member 52 enables it to be used with either end serving as the screw engaging forward tip and its opposite rearward portion used for being connected with the mandrel 56.

Figure 12:
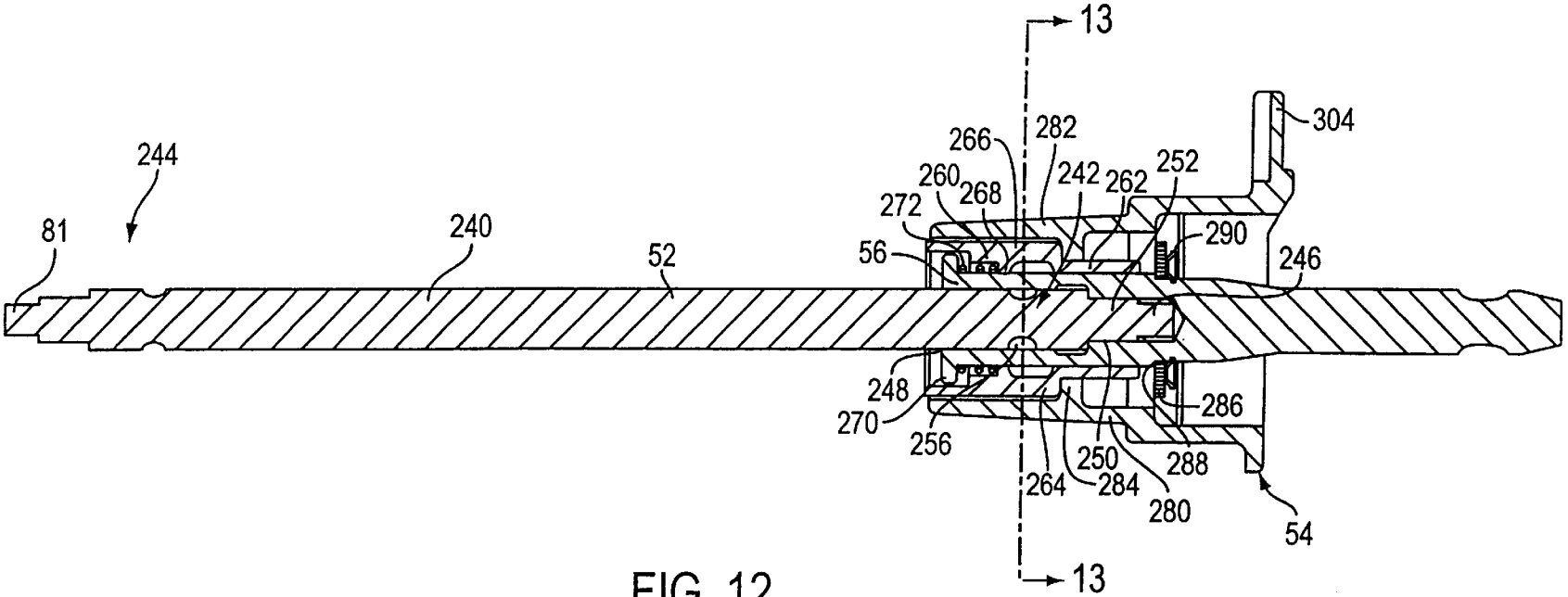
FIG. 12 is a cross-sectional view taken along the longitudinal axis of the bit member and bit locking assembly.

FIG. 12 is a longitudinal sectional view of the assembled bit member 52, screw bit locking assembly 54, and mandrel 56 depicted in FIG. 11. As shown, the connecting portion 242 is received within a longitudinal, hexagonally cross section bit member 248 in the mandrel 56. The opening 248 rearwardly into a reduced diameter, substantially cylindrical opening 250, which receives the substantially cylindrical end portion 252 of the bit member 52.

The connecting portion 242 of bit member 52 has an annular reduced diameter groove 256. The groove 256 forms a discontinuity in the hexagonally shaped exterior surface of the intermediate portion 240 of the bit member 52. In other words, the intermediate hexagonal portion 240 continues rearwardly beyond the groove 256 before it eventually transitions into the reduced diameter cylindrical portion 252.

Disposed in telescopic surrounding relation with respect to the mandrel 56 is a connecting sleeve member 260. The connecting sleeve member 260 has a relatively reduced inner diameter portion 262 towards the rearward end thereof. The connecting sleeve member 262 further includes a radially outwardly extending wall portion 264 which extends radially outwardly with respect to the sleeve portion 262. The connecting sleeve member 260 further includes a forward portion 266 having a generally cylindrical wall portion that is radially outwardly spaced from the exterior surface of the mandrel 56, and a radially inwardly disposed annular flange portion 268 which engages the exterior surface of the mandrel 56. The mandrel 56 has a radially outwardly extending flange 270 at a forward end thereof, and a coil spring 272 is disposed between the flange 270 of the mandrel 56 and the radially inwardly extending annular ridge 268 of the connecting sleeve member 260. The coil spring 272 is compressed between the flange 270 and the annular ridge 268 and tends to bias the entire connecting sleeve member rearwardly relative to the mandrel 56. A tubular bit release guide 280 also forms part of the locking assembly 54 and is disposed in surrounding relation to the connecting sleeve member 260 and with respect to the interfacing portions between the bit member 52 and the mandrel 56. The bit release guide 280 has a generally cylindrical wall portion 282 and an annular ridge 284 extending radially inwardly from the cylindrical wall 282.

An annular washer member 286 is disposed in surrounding relation to the mandrel 56 at an intermediate portion disposed rearwardly of the connecting sleeve member 260. The washer 286 is disposed rearwardly of an annular flange portion 288 formed as a reduced outer diameter step in the exterior surface of the mandrel 56. This flange surface 288 serves as a forward limiting position of the washer 286. A retaining ring 290 is disposed rearwardly of the washer 286 to fix the washer 286 in place relative to the mandrel, and prevents the washer from moving rearwardly off the mandrel 56. The washer 286 is made of a rigid metal material and serves as a rearward stop for the connecting sleeve member 260.

Figure 13:
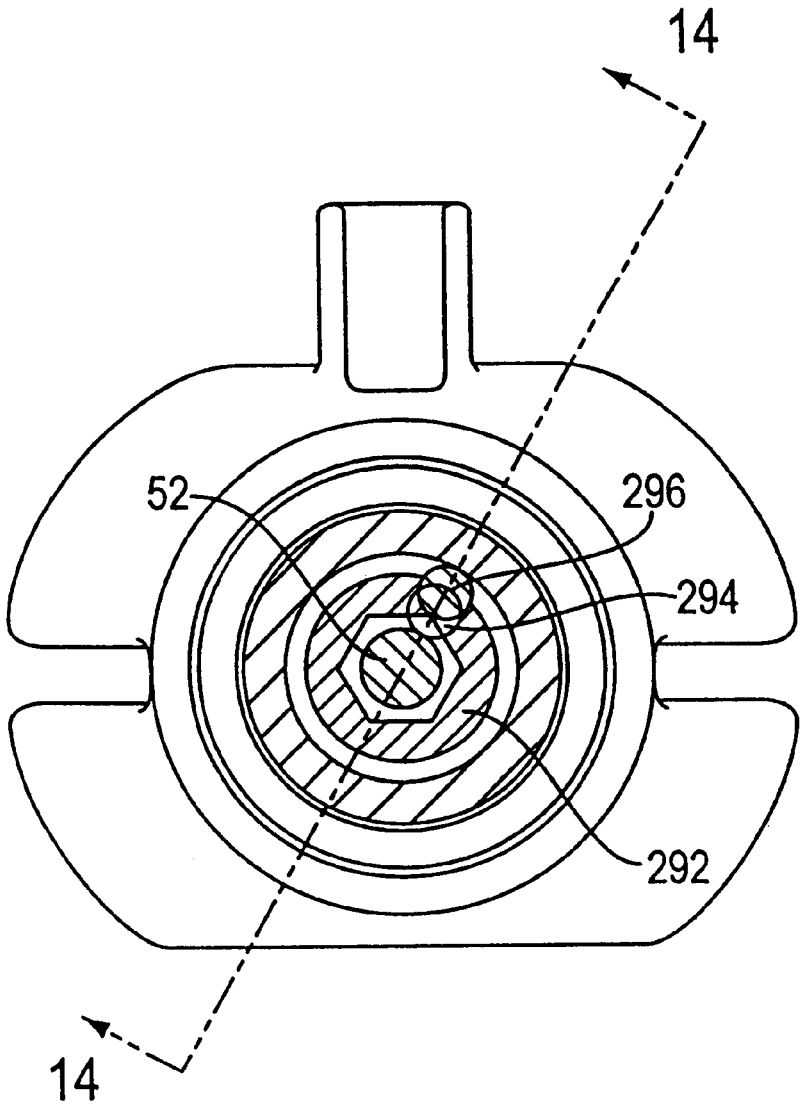
FIG. 13 is a cross-sectional view taken along line 13—13 in FIG. 12.
Figure 14:
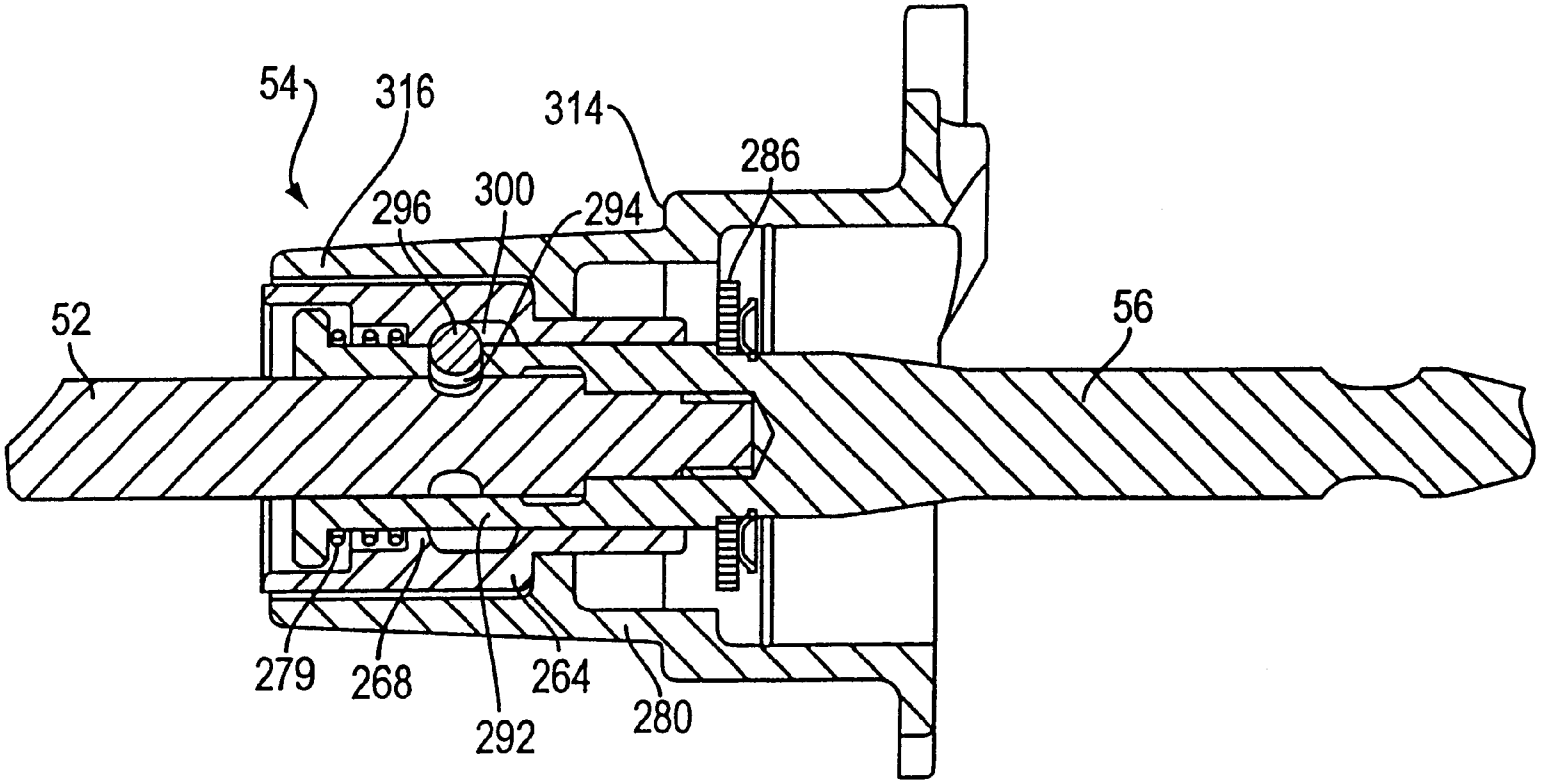
FIG. 14 is a cross-sectional view taken along line 14—14 in FIG. 13.

FIG. 13 is a sectional view taken through the line 13—13 in FIG. 12. In addition, FIG. 14 is a sectional view taken through the line 14—14 in FIG. 13. As can be discerned from FIGS. 13 and 14, the mandrel 56 has a generally tubular wall portion 292 having a lateral opening or hole 294 constructed and arranged to receive a bit locking structure in the form of a metal ball 296. The bias of coil spring 272 tends to force the ridge 268 of the connecting sleeve member 260 rearwardly to ride upon the exterior surface of the ball 296 and force the ball radially inwardly into locking engagement with the exterior surface of the bit 52. When the ball is aligned with the annular groove 256 in the bit 52, the bit locking assembly 54 effectively locks the bit member 52 in its operative position to the mandrel 56.

It can be appreciated that the locking assembly 54 prevents hex misalignment between the bit member 52 and the mandrel 56 as the ball 296 cannot lock the bit member 52 and mandrel 56 to one another unless the hex configurations of the bit and mandrel are properly aligned.

To release the bit member 52 from the mandrel 56, the bit release guide 280 is moved forwardly relative to the mandrel 56 so that the annular ridge 284 is forced against the annular wall 264 of the connecting sleeve member 260, and moves the sleeve member 260 forwardly against the bias of the coil spring 272. This action relieves the pressure applied to the ball 296 by the annular ridge 268 and enables the ball 296 to be moved out of the groove 256 in the bit member 52 and extend into a recess 300 formed in the connecting sleeve member 260 between the ridge 268 and the annular wall 264.

The bit release guide 280 has an upwardly extending release structure connecting projection 304. As can be appreciated from a cross sectional view shown in FIG. 4, this projection 304 is fixed to a manually engageable release structure 306. As can be appreciated from FIG. 3A, the release structure 306 is slidably mounted in a groove 308. Thus, to effect release of the bit member 52 in the manner described above, the release structure 306 is manually engaged and pushed forwardly within the groove 308 to affect forward movement of the connecting sleeve member 260 so as to move the locking assembly into released position wherein the ball 296 is released from its locking engagement with the groove 256 in the bit member 52. Alternately, to release the bit member 52 when the tool 14 is not connected with any screw gun, it is possible to release the bit member 52 simply by manually engaging the rearward end of the mandrel 56 and pulling rearwardly so that the flange 270 of the mandrel compresses the spring 272 against the ridge 278 of the connecting sleeve member 260. This movement of the mandrel will align the ball 296 with the chamber 300 formed in the connecting sleeve member 260 and permit the bit to be pulled forwardly from the mandrel 56 out of its operative position.

Returning now to FIG. 4, it can be seen that the depth setting structure 66 has an annular groove 310 disposed in a rearward portion thereof. The depth setting structure 66 is mounted for rotation as a result of ribs 312 defined by the plastic housing 16 extending into the annular groove 310. The depth setting structure 66 is disposed in surrounding relation with respect to the bit release guide 280, such that a portion of the interior surface of the structure 66 engages a portion of the exterior surface of the release guide 280.

The bit release guide 280 has an exterior surface thereof forming an annular flange or bearing surface 314 facing in axial forward direction. The surface 314 provides a resting or bearing surface for the rearward end coils of the coil spring 50. The forward portion of the interior surface of the depth setting structure 66 provides an external support to the rearward end coils of the spring 50. A forward portion 316 (see FIG. 14) of the bit release guide 280 extends forwardly into the interior of the coil spring 50 so as to provide internal support to the coil spring 50 to prevent buckling thereof. Similarly, the rearward tubular portion 320 of bit receiving portion 36 extends rearwadly into the forward end of the coil spring 50 to prevent buckling of the spring 50. In addition, the exterior surface of the bit receiving portion 36 forms a rearwardly facing annular flange or bearing surface 322 to provide a forward bearing surface or support for the front end coil of spring 50.

Figure 3A:
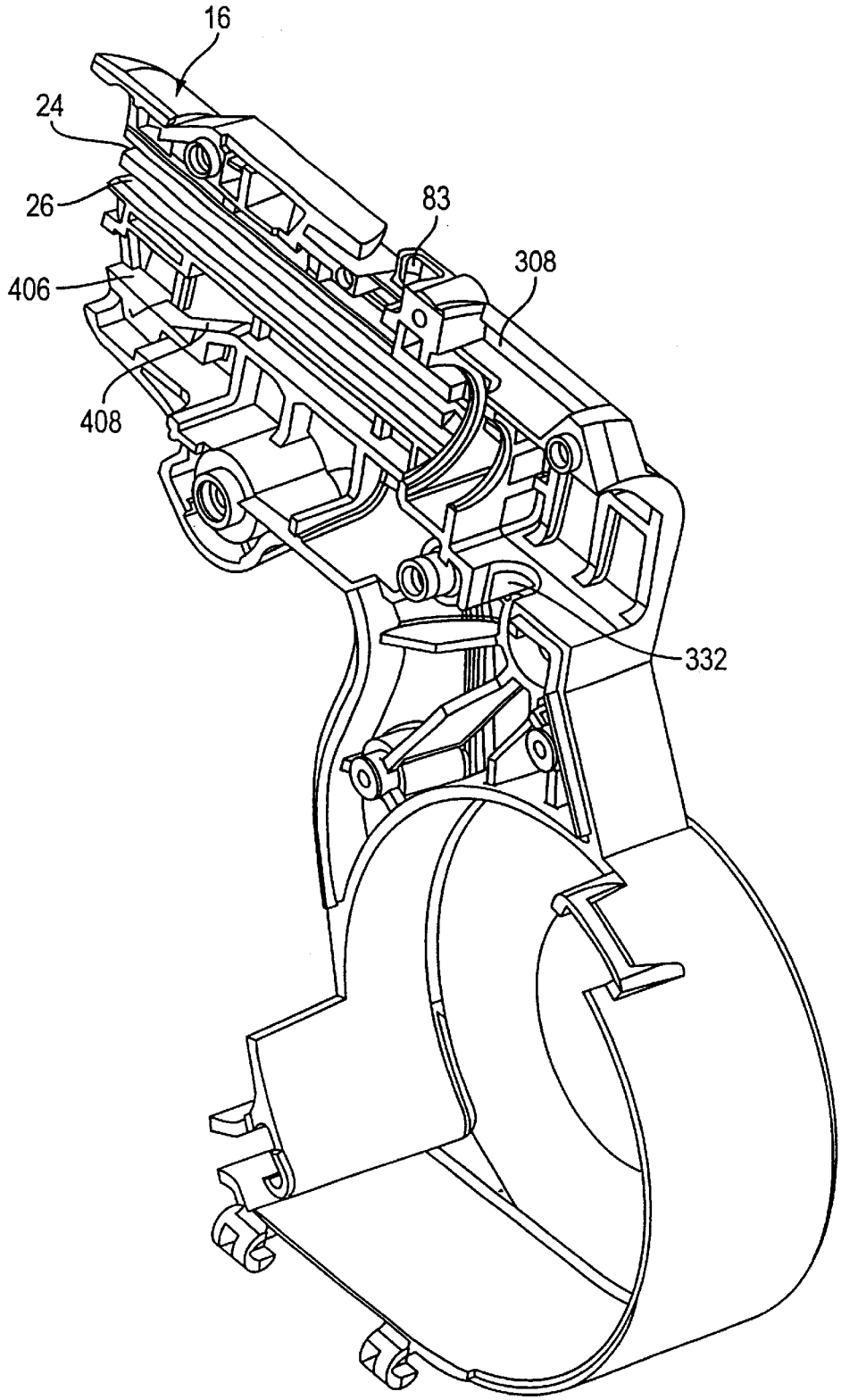
FIG. 3A is an upper rear perspective view of the interior of one of the housing halves.
Figure 3B:
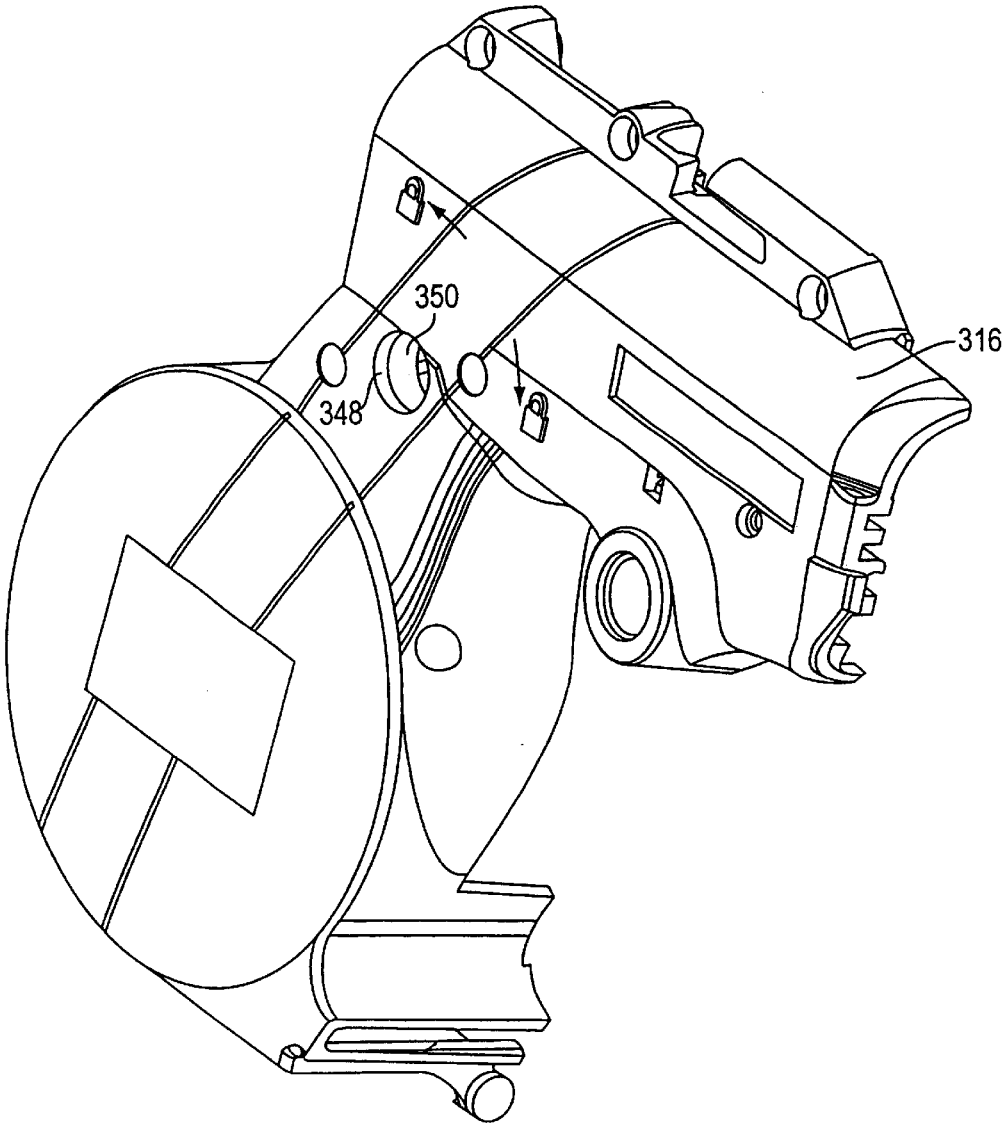
FIG. 3B is an upper front perspective view of the exterior of the housing half shown in FIG. 3A.
Figure 15:
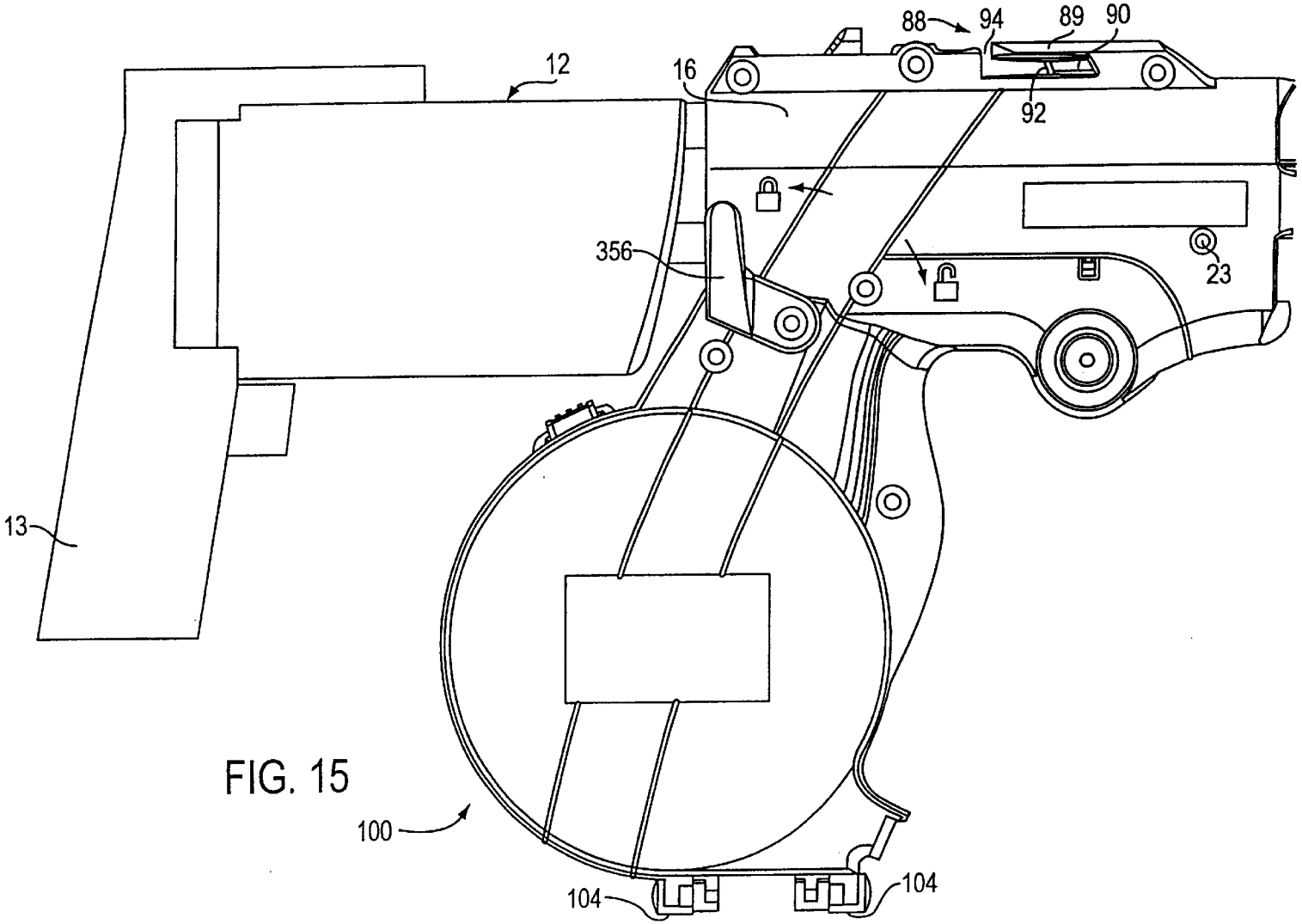
FIG. 15 is a side profile view showing the release member of the power source locking mechanism in a locked position.

Referring again to FIG. 4, it can be seen that the manually releasable locking mechanism 84 comprises a power source engaging structure 330 received in a vertically facing opening 332 in the housing structure 16 (see FIG. 3A). The power source engaging structure 330 is made of a plastic material and has a hollow configuration. A connecting member 334 connects the power source engaging structure 330 with a cam member 336. An upper portion 338 of the connecting member 334 is received within the hollow configuration of the power source engaging structure 330. A coil spring 340 is disposed between the upper surface of the upper portion 338 and the interior surface of the engaging structure 330 and applies an upward biasing force to the structure 330. The connecting member 334 has a C-shaped hook portion 342 defining a first leg portion and a second leg portion . The cam member 336 is received within the interior of the C-shaped hook portion 342. The cam member 336 extends laterally within the housing structure 16 and has opposite ends thereof rotatably mounted to the housing structure 16. One end of the cam member 336 has a groove which receive within an annular edge 348 (see FIG. 3B) extending radially inwardly from an opening 350 in the housing structure 16. As shown in FIG. 15, a manually engageable release member 356 is disposed on the exterior of the housing structure 16 for manual operation. In FIG. 15 and in FIG. 4, the power source engaging structure 330 is in a releasably locked position. To unlock the device 14 from the power source 12, the release member 356 is rotated in a clockwise direction in FIG. 15, which effects counterclockwise movement of the cam member 336 in FIG. 4. When the cam member 336 is rotated to an extent sufficient enough for a recessed portion 360 thereof to be disposed below the upper portion 338 of the connecting member 334, the power source engaging structure 330 will move downwardly into a released position wherein the power source engaging structure 330 is disengaged from the power source in such that the screwdriving device 14 can be disengaged from the rotary power source to thereby facilitate maintenance and cleaning.

In the locking position shown in FIG. 4, the power source engaging structure 330 is spring biased upwardly into its locked position so as to create a locking connection with screw gun 12. The spring bias of spring 334 removes a jiggle or play between the screwing device 14 and power source 12.

Referring further to FIG. 4, it can appreciated that the magazine assembly 100 has a generally cylindrical configuration and an exit opening 366 towards a forward lower portion thereof.

The exit opening 366 is particularly constructed and arranged so as to prevent collated screws, generally indicated at 370 from falling out of the magazine 100 as a result of the force of gravity acting upon the portion of collated screws extending between the exit opening 366 and the screw within the drive track 232. This is accomplished by providing the exit opening 366 in the form of an irregularly shaped, tortious channel which first extends upwardly and then extends downwardly so as to ride over a second collation engaging structure in the form of a projecting ridge 372 as it exits the magazine 100. Towards the beginning of the opening 366, the magazine assembly 100 provides a first collation engaging structure in the form of a generally downwardly extending projection 374 having a smoothly contoured convex collation engaging surface which maintains the collated screws 370 towards the bottom of the second collation engaging structure 372 while the collated screws 370 are behind the second collation engaging structure 372 within the magazine assembly 100. The exit opening 366 is further defined by a downwardly and forwardly extending projection 376 which terminates a position slightly forwardly of the ridge 372 and which prevents the collated screws 370 from simply extending from the bottom of the ridge in a direction straight upwardly and forwardly towards the drive track 232. The projection 376 defines a third collation engaging structure. Rather, the third collation engaging structure 376 forces the collated screws 370 to travel in the path which extends slightly downwardly or at least substantially horizontally after passing the second collation engaging structure 372. As a result, each screw within the collation 370 engages and ride upwards the second collation engaging structure 372 and then move downwardly over the second collation engaging structure after it exits beyond the second collation engaging structure 372, causing the plastic collation 380 (which holds the screws to one another) to flex in a slightly undulating or tortious path and then exits the magazine assembly 100 through the exit opening 366. This, as a result, prevents the collated screws 370 from falling out of the magazine assembly 100, even as the last few screws exit the magazine assembly 100.

The operation of the screwdriving device 14 will now be described.

Figure 16:
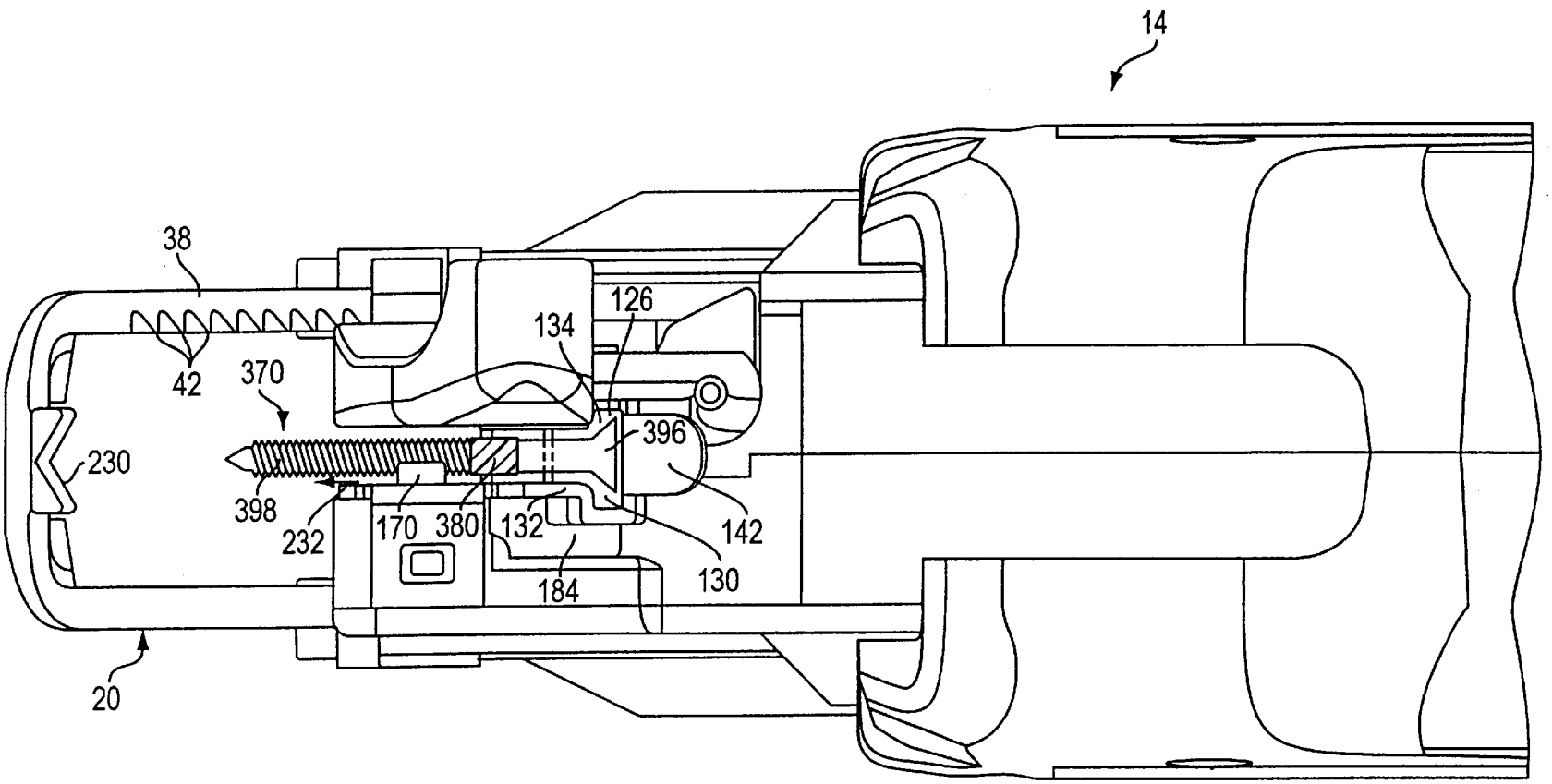
FIG. 16 is a top plan view of the feeding assembly with a lead screw received in the drive track and the workpiece contacting structure removed.

FIG. 16 is a bottom plan view of the screwdriving device 14. As can be appreciated from this figure and FIG. 8B, the collated screws 370 are fed upwardly into the channel 126, so that the lead screw 398 is disposed in the forwardly extending drive track 232, with the head 396 of the lead screw being fed upwardly into the slot 122.

The lead screw 398 of the collated screws 370 is manually manipulated (e.g., by pulling upwardly on the upper extent of the plastic collation 380) so that the aforesaid lead screw 398 (see FIG. 17) is forced to ride over the screw engaging portion 170 of the screw feeding structure 124 by forcing the screw feeding structure 124 to pivot away from the drive track 232 about its lower projection 144. Because the screw engaging portion 170 has a smoothly contoured generally convex screw engaging surface facing the upwardly moving lead screw, it is easily moved out of the channel 126 to enable the lead screw 398 to be moved into axial alignment with the bit member 52. Assuming the screw depth and screw length have been properly adjusted, a screwing operation can now commence.

The screw gun 12 is grabbed by its handle 13 (see FIG. 1), and the forward workpiece engaging surface 80 of the workpiece contacting structure 20 is placed and then forced against the surface of a workpiece. This forcing action causes the workpiece contacting structure 20 to move slightly rearwardly relative to the body 110 as a result of rearward movement of the slider body 204 of the body 110 against the bias of torsion spring 212. Such relative movement between the workpiece contacting structure 20 and the feeding body 110 continues until the forward tip of the successive lead screw 400 beneath the lead screw 398 engages the inner surface 230 of the nose extension 38 (i.e., the workpiece contacting portion) of workpiece contacting structure 20 (see FIG. 17). In addition, the head 396 of the second screw 400 engages the adjacent wall or surface 234 of the bushing 120 so as to be sandwiched between the surfaces 230 and 234 and prevent further forward movement of the body 110. Continued forced movement of the device 14 in a forward direction causes the housing structure 16 together with the bit member 52 to be moved forwardly until the forward tip 81 of the bit member 52 is moved into a square shaped opening provided in the head of the lead screw 398. After the tip 81 engages the head of the lead screw 398, continued forced forward movement of the device 14 causes the housing structure 16 to be moved forwardly with respect to the bit member 52. In particular, after the tip 81 of the bit member 52 engages the head of the screw 398, continued forward movement of the tool housing structure 16 continues while forward movement of the bit member 52 is prevented by the engagement of the tip 81 with the screw 398, so as to effect compression of the coil spring 272 (see FIG. 4). In addition, because the mandrel 56 is connected with bit member 52, forward movement of the housing structure 16 relative to the bit member 52 also occurs relative to the mandrel 56. As a result, the forward housing portion of the conventional screw gun 12 which is fixed to the housing structure 16 via locking assembly 84 is moved forwardly relative to the mandrel engaging portion of the screw gun. This relative movement between the screw gun housing and the screw gun mandrel engaging portion effects engagement of an internal clutch in the screw gun 12 in conventional fashion. Engagement of this clutch effects rotation of the mandrel engaging portion of the screw gun 12. Because this mandrel engaging portion of the screw gun 12 is connected with the rear end of the mandrel 56 of the screwdriving device 14, the mandrel 56 and bit member 52 are rotated about the common longitudinal axis to effect screwing of the lead screw 398 into a work piece (see FIG. 17).

Figure 17:
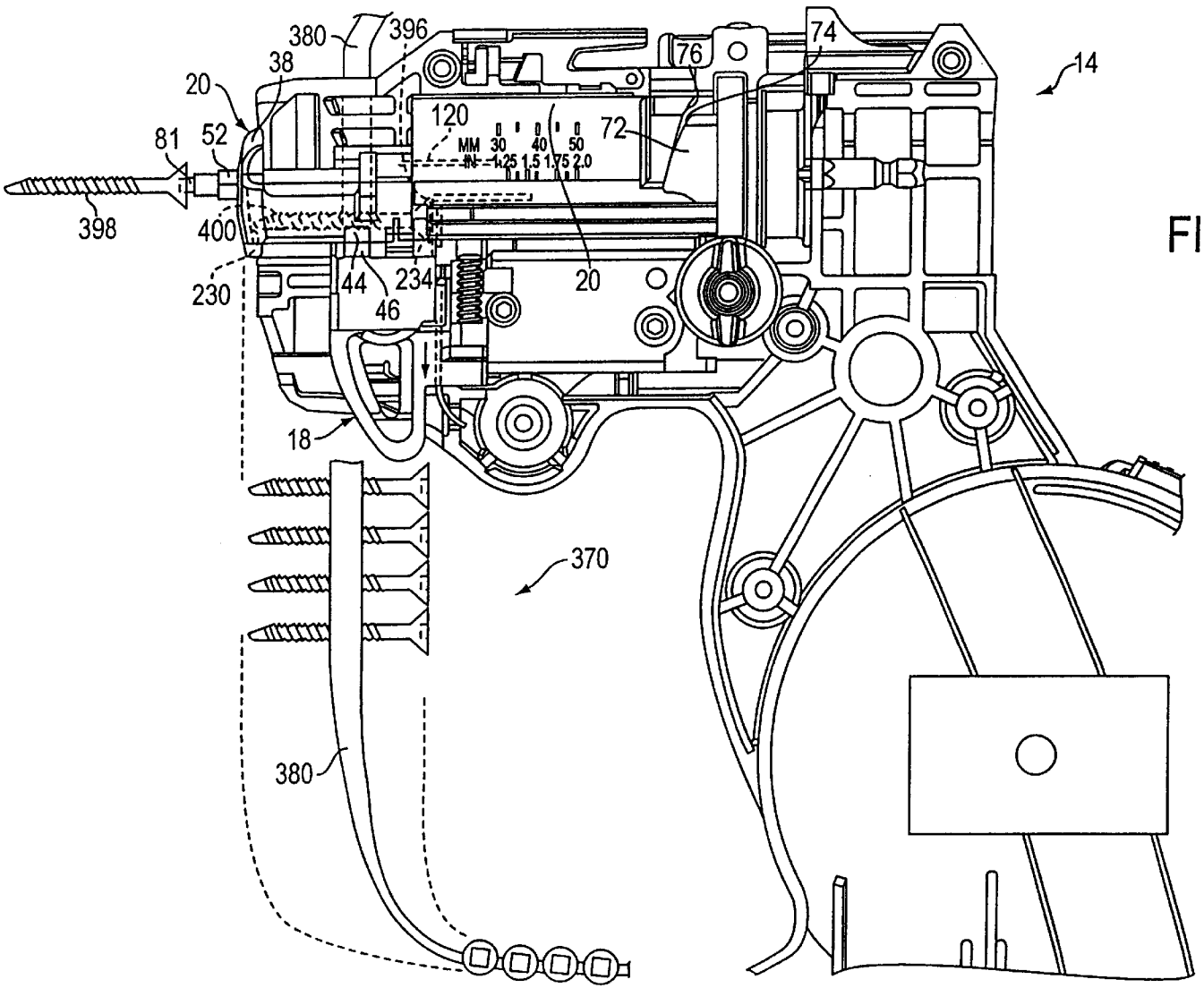
FIG. 17 is a side view of the device with one housing half removed and illustrating the relationship of the components when in a fully driven position.

As the screw 398 is screwed into the workpiece, the housing structure 16, bit locking assembly 54, and bit member 52 are progressively moved forwardly relative to the feeding assembly 18 and the drive track 232. During this action, the coil spring 50 (see FIG. 4) is compressed. In addition, during this movement, the outwardly projection or pin 164 which extends laterally outwardly of the clam shell housing half 114 of the body 18 (see FIGS. 6 and 8A, 8B) has a lower surface thereof which rides along the upwardly facing lever engaging surface 406 providing the plastic outer housing structure 16 as shown in FIG. 3A. This surface 406 transitions into an upwardly extending ramp portion as indicated at 408. When the projection 164 reaches the ramp portion 408, the lever member 148 (see FIG. 6) is pivoted about the mounting pin 150 against the bias of torsion spring 152 so as to move the screw feeding structure 124 downwardly. This downward movement of the screw feeding structure 124 continues as the screw engaging portion 170 thereof has the convex exterior surface thereof ride over the successive lead screw 400 as indicated in FIG. 17. The screw feeding structure 124 is pivoted slightly about its projection 144 received in opening 146 of the lever member 148 so that the screw engaging portion 170 is moved slightly inwardly into its lead screw disengaged position within cover member 132 as it rides over the successive lead screw 400. The successive lead screw 400 is held rigidly in place during this movement of the screw engaging portion 170 thereover as a result of the sandwiched engagement of the successive lead screw 400 between the surfaces 230 and 234. The screw engaging portion 170 of the screw feeding structure 124 remains beneath the successive lead screw 400 during the remainder of the screwing of the lead screw 398 into the workpiece. Screwing continues, together with compression of major coil spring 50 until the engaging surface 76 of the workpiece contacting structure 20 engages the feeding assembly engaging surface 74 of cam structure 72 (see FIG. 17). At this point, further forward movement of the housing structure 16, bit locking assembly 54, and bit member 52 relative to the workpiece contacting structure 20 engaging the workpiece is prevented. Shortly thereafter, tip 81 of the bit member 52 becomes disengaged from the head of the lead screw 398. When the coil spring 272 of the connecting structure 54 is permitted to expand so as to effect relative movement between the mandrel 56 and the housing structure 16, the clutch provided in the screw gun 12 is disengaged and the rotary motion of the bit member 52 is terminated. As the device 14 is moved away from the workpiece, the coil spring 50 retains the workpiece contacting structure 20 against the workpiece as the housing structure 16 is first moved away, with the coil spring 50 providing relative movement between the feeding assembly 18 and the housing structure 16 (i.e., the feeding assembly 18 is extended outwardly relative to the housing structure 16). During this relative movement between the feeding assembly 18 and the housing structure 16 under the force of coil spring 50, the projection 164 extending outwardly of the housing half 114 of the feeding assembly 18 rides downward the ramp 406 provided within the housing structure 16. As a result, the lever member 148 is pivoted in a clockwise direction in FIG. 6 under the force of torsion spring 152 so as to move the screw feeding structure 124 in an upwards direction. During this upward movement of the screw feeding structure 124, the screw engaging portion 170 thereof engages the underside of the successive lead screw 400 (or surrounding collation 380) to move the successive lead screw 400 into the drive track 232 in longitudinal axial alignment with the now retracted bit member 52. The device 14 is now ready for a second screwing operation.

Figure 20:
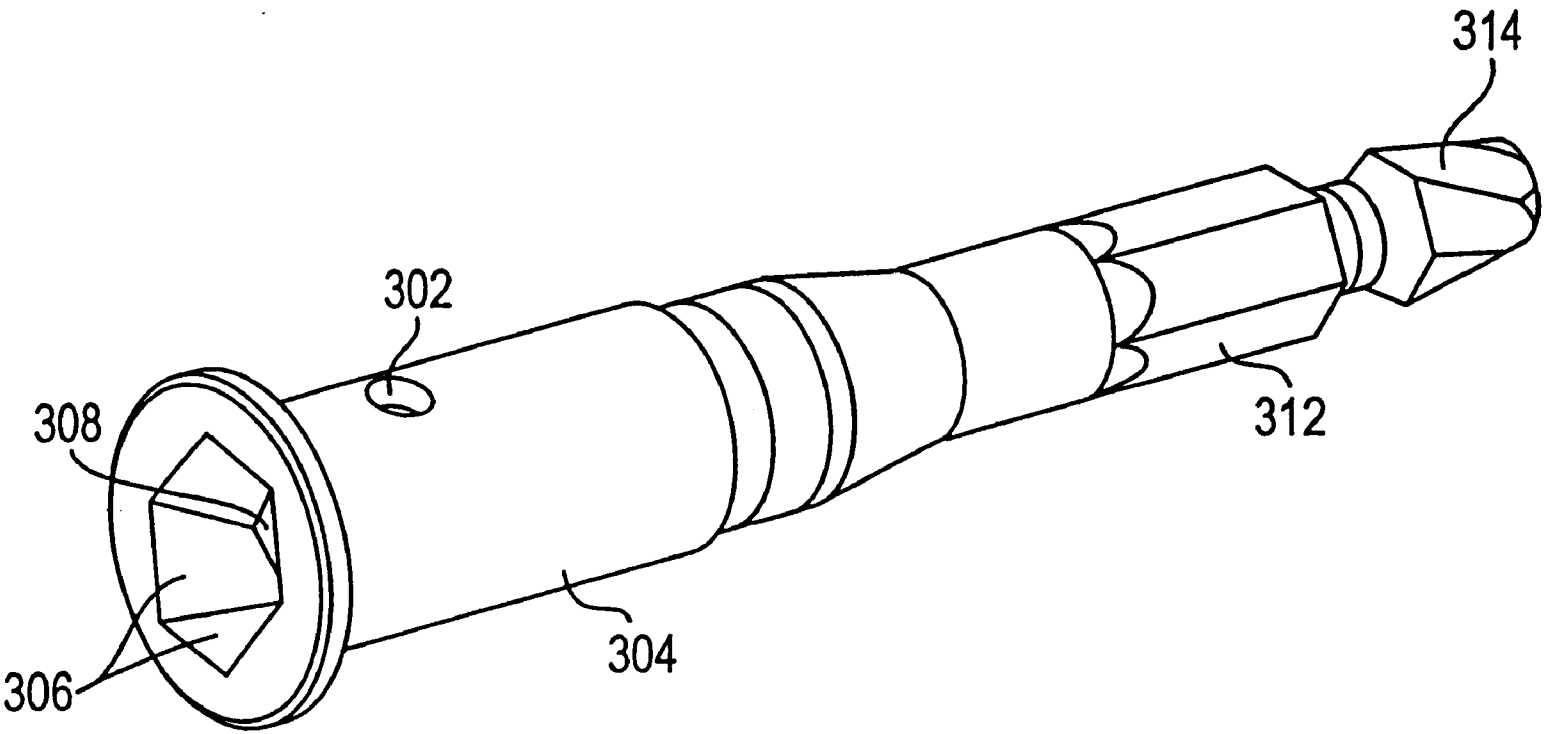
FIG. 20 shows an alternative construction for the bit member and bit locking assembly.

FIG. 20 show an alternate construction for the mandrel of the bit locking assembly. The bit locking assembly operates in the same manner as the bit locking assembly described above in that a bit locking ball is received within an opening 302 formed radially through the wall of the mandrel 304. The mandrel has bit aligning surfaces 306 disposed adjacent the bit receiving opening 308. The bit member 52 has a hexagonal shape with axially extending engaging surfaces which engage and mate with associated surfaces (not shown) in the opening 308. The bit aligning surfaces 306 extend helically with respect to the bit receiving opening 308. The bit member aligning surfaces 306 are positioned and configured such that forced axial engagement of the bit member 52 with the bit locking assembly 300 causes relative rotational movement between the bit member 52 and the assembly 300 until the bit member is properly aligned with the opening 308 and can be inserted therein. It is to be understood that such surfaces could also be provided on the end of the bit member 52 to facilitate installtion into standard mandrels.

Likewise, the power source connecting portion 312 of the mandrel 304 has connecting member aligning surfaces 314 provided thereon. The connecting member 312 is constructed and arranged to be inserted into a connecting member receiving opening (not shown) on the rotary power source to thereby provide rotational movement of the bit member 52. The connecting member aligning surfaces extend helically with respect to the connecting portion 312. The connecting member aligning surfaces 314 are configured to cause the connecting member 312 (and hence mandrel 304) to rotate relative to the connecting member receiving opening until the connecting member is properly aligned relative to the connecting member receiving opening and allowed to be moved generally axially into the connecting member receiving opening.

Any U.S. patents or patent application mentioned hereinabove and not expressly incorporated, by reference are hereby incorporated into the present application by reference.

It should be noted that the use of "mean-plus-function" language has been omitted from the appended claims. This is to clearly point out that the applicants do not intend the claims to be interpreted under 35 U.S.C. § 112, paragraph 6 and do not intend the claim scope to be limited to the specific structures disclosed or their structural equivalents.

What is claimed:

1. A power-operated screwdriving device configured to be used with a rotary power source and a supply of screws releasably mounted on a collation, said screwdriving device comprising:

a housing structure constructed and arranged to be engaged with the rotary power source, said housing providing a depth setting structure access opening;

a feeding assembly defining a drive track carried by said housing and providing a workpiece engaging surface;

said drive track being configured to receive a lead screw from the supply of screws;

a rotatable screw engaging bit member constructed and arranged to be operatively connected to the rotary power source such that the rotary power source rotates said screw engaging bit member during a screwdriving operation wherein said workpiece engaging surface is engaged with a surface of a workpiece and the lead screw is driven into the workpiece;

said rotatable screw engaging bit member being movable relative to said drive track and said workpiece engaging surface such that, when said workpiece engaging surface is engaged with the surface of the workpiece, rotation of said bit member and relative movement between said bit member and said drive track drives the lead screw into the workpiece during the screwdriving operation;

screw depth setting structure located within said housing and providing a feeding assembly engaging surface that extends helically with respect to an axis of said depth setting structure, said screw depth setting structure being positioned and configured such that said feeding assembly engaging surface engages said feeding assembly to thereby limit the relative movement occurring between said screw engaging bit member and said workpiece engaging surface during said screwdriving operation, said depth setting structure being turnable about said axis thereof so that the amount of said relative movement occurring between said screw engaging bit member and said workpiece engaging surface during said screwdriving operation for each angular position of said depth setting structure is determined by the orientation of said helically extending depth setting structure;

said workpiece engaging surface and said rotatable screw engaging bit member being constructed and arranged such that, when said feeding assembly is engaged with the feeding assembly engaging surface, a distance between a screw engaging end portion of said bit member and said workpiece engaging surface determines the depth to which the lead screw will be driven relative to the surface of the workpiece during said screwdriving operation;

a manually engageable screw depth adjusting member disposed exteriorly of said housing structure and operatively connected to said screw depth setting structure through said depth setting structure access opening, said screw depth adjusting member being constructed and arranged such that manual operation thereof turns said screw depth setting structure about said axis thereof to orient said helically extending feeding assembly engaging surface for adjustment of the depth to which the lead screw will be driven to the surface of the workpiece during said screwdriving operation.

2. A power-operated screwdriving device according to claim 1, further comprising a motion transmitting structure operatively connecting said screw depth adjusting member and said screw depth setting structure such that manual movement of said screw depth adjusting member causes rotation of said screw depth setting structure.

3. A power-operated screwdriving device according to claim 2, wherein said screw depth setting structure has a set of circular gear teeth formed thereon, said motion transmitting structure being a worm gear, said worm gear being operatively connected with said screw depth adjusting member and intermeshed with said set of gear teeth on said screw depth setting structure such that movement of said screw depth adjusting member rotates said worm gear so as to cause rotation of screw depth setting structure through said range of adjustable positions.

4. A power-operated screwdriving device according to claim 3, wherein said screw depth adjusting member is a manually engageable knob disposed on the exterior of said housing structure and fixedly connected to said worm gear such that rotation of said knob rotates said worm gear.

5. A power-operated screwdriving device according to claim 4, wherein said housing structure has a depth setting structure viewing window formed therethrough, said screw depth setting structure and said depth setting structure viewing window being positioned and configured such that the distance between said screw engaging end portion of said bit member and said workpiece engaging surface is related to an amount of viewing area in said viewing window occupied by said screw depth setting structure, thereby allowing an operator to determine the depth to which the lead screw will be driven by looking into said viewing window.

6. A power-operated screwdriving device according to claim 4, wherein said feeding assembly includes a body and an adjustable workpiece contacting structure mounted on said body, said workpiece contacting structure providing said workpiece engaging surface, said workpiece contacting structure being constructed and arranged to be moved relative to said body through a range of adjustable positions to enable said workpiece contacting structure in be positioned in accordance with a length of the lead screw proximal a penetrating end of the lead screw to thereby minimize a distance between the penetrating end and the surface of the workpiece prior to driving the lead screw into the workpiece;

a contacting structure locking structure movable rectilinearly between (1) a locking position wherein said locking structure engages said workpiece contacting structure to thereby limit movement of said workpiece contacting structure relative to said body within said range of adjustable positions and (2) an unlocked position wherein said locking structure is unlocked from said workpiece contacting structure to thereby allow said workpiece contacting structure to be moved through said range of adjustable positions.

7. A power-operated screwdriving device according to claim 6, wherein said feeding assembly engaging surface of said depth setting structure engages a rearward surface of said workpiece contacting structure.

8. A power-operated screwdriving device according to claim 7, wherein said contacting structure locking structure is a door structure mounted to said feeding assembly, said door structure being movable, when in said unlocked position, between (1) an open position allowing access to an interior of said feeding assembly and the screws and portions of collation disposed said interior and (2) a closed position wherein said door structure inhibits access to said interior of said feeding assembly.

9. A power-operated screwdriving device according to claim 8, wherein said door structure has an locking projection and wherein said workpiece contacting structure has a set of locking teeth, said locking projection being positioned and configured to removably engage said teeth when said door structure is in said locked position.

10. A power-operated screwdriving device according to claim 9, wherein said workpiece contacting structure provides a subsequent lead screw contacting surface opposite said workpiece contacting surface, said locking projection being movably mounted on said door structure such that, when said door structure is in said locked position, force applied to said device towards the workpiece when the workpiece engaging surface is engaged with the workpiece will cause limited relative movement between said contacting structure and said body until said subsequent lead screw contacting surface contacts a penetrating end of the subsequent lead screw so as to terminate the relative movement between said workpiece contacting structure and said body.

11. A power-operated screwdriving device according to claim 10, further comprising a biasing spring disposed between said door structure and said locking projection, said biasing spring being configured to bias said locking projection and said workpiece contacting structure forwardly with respect to said door structure.

12. A power-operated screwdriving device according to claim 11, wherein said workpiece contacting structure comprises a rear half-shell portion and a forward workpiece contacting portion, said workpiece contacting portion having a pair of forwardly extending arms and a forward member interconnecting said arms, said forward member providing said workpiece engaging surface, said arms being spaced apart such that the collation and the screws pass between said arms as said feeding assembly feeds the collation and screws into said drive track.

13. A power operated screwdriving device according to claim 12, wherein a rear part of said rear half-shell portion is received within said housing structure and a front part of said rear half-shell portion extends outwardly from said housing structure, said half-shell portion having a set of screw length markings provided on an exterior surface thereof, said screw length markings being positioned and configured such that an operator can disengage said door structure from said locking teeth, move said workpiece contacting structure to an adjusted position wherein an edge of said housing structure is aligned with one of said screw length markings corresponding to a desired screw length, and then engage said door structure with said locking teeth to thereby fix said adjustable workpiece contacting structure at the position corresponding to the desired screw length.

14. A power-operated screwdriving device according to claim 5, wherein said feeding assembly includes a body and an adjustable workpiece contacting structure mounted on said body, said workpiece contacting structure providing said workpiece engaging surface and a subsequent lead screw engaging surface opposite said workpiece engaging surface, said workpiece contacting structure being constructed and arranged to be moved relative to said body through a range of adjustable positions to enable said workpiece contacting structure to be positioned in accordance with a length of the lead screw wherein force applied to said device towards the workpiece, when the workpiece engaging surface is engaged with the workpiece, will cause limited relative movement between said contacting structure and said body until said subsequent lead screw engaging surface contacts a penetrating end of the subsequent lead screw so as to terminate relative movement between the workpiece contacting structure and said body and hold the supply of collated screws as the lead screw is being driven into the workpiece;

a contacting structure locking structure movable rectilinearly between (1) a locking position wherein said locking structure engages said workpiece contacting structure to thereby limit movement of said workpiece contacting structure relative to said body within said range of adjustable positions and (2) an unlocked position wherein said locking structure is unlocked from said workpiece contacting structure to thereby allow said workpiece contacting structure to be moved through said range of adjustable positions.

15. A power-operated screwdriving device according to claim 14, wherein said feeding assembly engaging surface of said depth setting structure engages a rearward surface of said workpiece contacting structure.

16. A power-operated screwdriving device according to claim 15, wherein said contacting structure locking structure is a door structure mounted to said feeding assembly, said door structure being movable, when in said unlocked position, between (1) an open position allowing access to an interior of said feeding assembly and the screws and portions of collation disposed said interior and (2) a closed position wherein said door structure inhibits access to said interior of said feeding assembly.

17. A power-operated screwdriving device configured to be used with a rotary power source and a supply of screws releasably mounted on a collation, said screwdriving device comprising:

a housing structure constructed and arranged to be engaged with the rotary power source;

a feeding assembly defining a drive track constructed and arranged to receive a lead screw from the supply of screws;

said feeding assembly including a body and an adjustable workpiece contacting structure mounted on said body, said workpiece contacting structure providing a workpiece engaging surface, a rotatable screw engaging bit member constructed and arranged to be operatively connected to the rotary power source such that the rotary power source rotates said bit member during a screwdriving operation wherein said workpiece engaging surface is engaged with a surface of a workpiece and the lead screw is driven into the workpiece;

said workpiece contacting structure being constructed and arranged to be moved relative to said body through a range of adjustable positions to enable said workpiece contacting structure to be positioned in accordance with a length of the lead screw proximal a penetrating end of the lead screw to thereby minimize a distance between the penetrating end and the surface of the workpiece prior to driving the lead screw into the workpiece;

a contacting structure locking structure movable rectilinearly between (1) a locking position wherein said locking structure engages said workpiece contacting structure to thereby limit movement of said workpiece contacting structure relative to said body within said range of adjustable positions and (2) an unlocked position wherein said locking structure is unlocked from said workpiece contacting structure to thereby allow said workpiece contacting structure to be moved through said range of adjustable positions; said rotatable screw engaging bit member being movable relative to said drive track and said workpiece engaging surface such that, when said workpiece engaging surface is engaged with the surface of the workpiece, rotation of said screw engaging bit member and relative movement between said screw engaging bit member and said drive track drives the lead screw into the workpiece during said screwdriving operation.

18. A power-operated screwdriving device according to claim 17, wherein said contacting structure locking structure is a door structure mounted to said feeding assembly, said door structure being movable, when in said unlocked position, between (1) an open position allowing access to an interior of said feeding assembly and the screws and portions of collation disposed in said interior and (2) a closed position wherein said door structure inhibits access to said interior of said feeding assembly.

19. A power-operated screwdriving device according to claim 18, wherein said door structure has an locking projection and wherein said workpiece contacting structure has a set of locking teeth, said locking projection being positioned and configured to removably engage said teeth when said door structure is in said locked position.

20. A power-operated screwdriving device according to claim 19, wherein said workpiece contacting structure provides a subsequent lead screw contacting surface opposite said workpiece contacting surface, said locking projection being movably mounted on said door structure such that, when said door structure is in said locked position, force applied to said device towards the workpiece when the workpiece engaging surface is engaged with the workpiece will cause limited relative movement between said contacting structure and said body until said subsequent lead screw contacting surface contacts a penetrating end of the subsequent lead screw so as to terminate the relative movement between said workpiece contacting structure and said body.

21. A power-operated screwdriving device according to claim 20, further comprising a biasing spring disposed between said door structure and said locking projection, said biasing spring being configured to bias said locking projection and said workpiece contacting structure forwardly with respect to said door structure.

22. A power-operated screwdriving device according to claim 21, wherein said workpiece contacting structure comprises a rear half-shell portion and a forward workpiece contacting portion, said workpiece contacting portion having a pair of forwardly extending arms and a forward member interconnecting said arms, said forward member providing said workpiece engaging surface, said arms being spaced apart such that the collation and the screws pass between said arms as said feeding assembly feeds the collation and screws into said drive track.

23. A power operated screwdriving device according to claim 22, wherein a rear part of said rear half-shell portion is received within said housing structure and a front part of said rear half-shell portion extends outwardly from said housing structure, said half-shell portion having a set of screw length markings provided on an exterior surface thereof, said screw length markings being positioned and configured such that an operator can disengage said door structure from said locking teeth, move said workpiece contacting structure to an adjusted position wherein an edge of said housing structure is aligned with one of said screw length markings corresponding to a desired screw length, and then engage said door structure with said locking teeth to thereby fix said adjustable workpiece contacting structure at the position corresponding to the desired screw length.

24. A power-operated screwdriving device according to claim 22, wherein said workpiece contacting portion is fastened to said rear half-shell portion by a pair of fasteners.

25. A power-operated screwdriving device according to claim 17, further comprising:

screw depth setting structure providing a feeding assembly engaging surface, said screw depth setting structure being positioned and configured such that said feeding assembly engaging surface engages a rearward surface of said workpiece contacting structure to thereby limit the relative movement occurring between said bit member and said workpiece engaging surface during said screwdriving operation;

said workpiece engaging surface and said rotatable screw engaging bit member being constructed and arranged such that, when said workpiece contacting structure is engaged with the feeding assembly engaging surface, a distance between a screw engaging end portion of said bit member and said workpiece engaging surface determines the depth to which the lead screw will be driven relative to the surface of the workpiece during said screwdriving operation;

a manually engageable screw depth adjusting member disposed exteriorly of said housing structure and operatively connected to said screw depth setting structure, said screw depth adjusting member being constructed and arranged such that manual operation thereof moves said screw depth setting structure through a range of adjustable positions to thereby adjust the depth to which the lead screw will be driven to the surface of the workpiece during said screwdriving operation.

26. A power-operated screwdriving device according to claim 25, wherein said screw depth setting structure is mounted for rotational movement within said housing structure, said feeding assembly engaging surface having a helical configuration and being aligned coaxially with said screw engaging bit member such that manual movement of said screw depth adjusting member rotates said screw depth setting structure through the range of adjustable positions.

27. A power-operated screwdriving device according to claim 26, further comprising a motion transmitting structure operatively connecting said screw depth adjusting member and said screw depth setting structure such that manual movement of said screw depth adjusting member causes rotation of said screw depth setting structure.

28. A power-operated screwdriving device according to claim 27, wherein said screw depth setting structure has a set of circular gear teeth formed thereon, said motion transmitting structure being a worm gear, said worm gear being operatively connected with said screw depth adjusting member and intermeshed with said set of gear teeth on said screw depth setting structure such that movement of said screw depth adjusting structure rotates said worm gear so as to cause rotation of screw depth setting structure through said range of adjustable positions.

29. A power-operated screwdriving device according to claim 28, wherein said screw depth adjusting structure is a manually engageable knob disposed on the exterior of said housing structure and fixedly connected to said worm gear such that rotation of said knob rotates said worm gear.

30. A power-operated screwdriving device according to claim 29, wherein said housing structure has a depth setting structure viewing window formed therethrough, said screw depth setting structure and said depth setting structure viewing window being positioned and configured such that the distance between said screw engaging end portion of said bit member and said workpiece engaging surface is related to an amount of viewing area in said viewing window occupied by said screw depth setting structure, thereby allowing an operator to determine the depth to which the lead screw will be driven by looking into said viewing window.

31. A power-operated screwdriving device according to claim 30, wherein said rearward surface of said workpiece contacting structure has a helical configuration complementing the helical configuration of said feeding assembly engaging surface.

32. A power-operated screwdriving device configured to be used with a rotary power source and a supply of screws releasably mounted on a collation, said screwdriving device comprising:

a housing structure constructed and arranged to be engaged with the rotary power source;

a feeding assembly defining a drive track constructed and arranged to receive a lead screw from the supply of screws;

said feeding assembly including a body and an adjustable workpiece contacting structure mounted on said body, said workpiece contacting structure providing a workpiece engaging surface and a subsequent lead screw engaging surface opposite said workpiece engaging surface, a rotatable screw engaging bit member constructed and arranged to be operatively connected to the rotary power source such that the rotary power source rotates said bit member during a screwdriving operation wherein said workpiece engaging surface is engaged with a surface of a workpiece and the lead screw is driven into the workpiece;

said workpiece contacting structure being constructed and arranged to be moved relative to said body through a range of adjustable positions to enable said workpiece contacting structure to be positioned in accordance with a length of the lead screw wherein force applied to said device towards the workpiece when the workpiece engaging surface is engaged with the workpiece will cause limited relative movement between said contacting structure and said body until said subsequent lead screw engaging surface contacts a penetrating end of the subsequent lead screw so as to terminate relative movement between the workpiece contacting structure and said body so as to hold the supply of collated screws as the lead screw is being driven into the workpiece;

a contacting structure locking structure movable between (1) a locking position wherein said locking structure engages said workpiece contacting structure to thereby limit movement of said workpiece contacting structure relative to said body within said range of adjustable positions and (2) an unlocked position wherein said locking structure is unlocked from said workpiece contacting structure to thereby allow said workpiece contacting structure to be moved through said range of adjustable positions;

said rotatable screw engaging bit member being movable relative to said drive track and said workpiece engaging surface such that, when said workpiece engaging surface is engaged with the surface of the workpiece, rotation of said screw engaging bit member and relative movement between said screw engaging bit member and said drive track drives the lead screw into the workpiece during said screwdriving operation.

33. A power-operated screwdriving device according to claim 32, wherein said contacting structure locking structure is a door structure mounted to said feeding assembly, said door structure being movable, when in said unlocked position, between (1) an open position allowing access to an interior of said feeding assembly and the screws and portions of collation disposed in said interior and (2) a closed position wherein said door structure inhibits access to said interior of said feeding assembly.

34. A power-operated screwdriving device according to claim 33, wherein said door structure has an locking projection and wherein said workpiece contacting structure has a set of locking teeth, said locking projection being positioned and configured to removably engage said teeth when said door structure is in said locked position.

35. A power-operated screwdriving device according to claim 34, wherein said locking projection is movably mounted on said door structure to provide the limited relative movement between said contacting structure and said body.

36. A power-operated screwdriving device according to claim 35, further comprising a biasing spring disposed between said door structure and said locking projection, said biasing spring being configured to bias said locking projection and said workpiece contacting structure forwardly with respect to said door structure.

37. A power-operated screwdriving device according to claim 36, wherein said workpiece contacting structure comprises a rear half-shell portion and a forward workpiece contacting portion, said workpiece contacting portion having a pair of forwardly extending arms and a forward member interconnecting said arms, said forward member providing said workpiece engaging surface, said arms being spaced apart such that the collation and the screws pass between said arms as said feeding assembly feeds the collation and screws into said drive track.

38. A power operated screwdriving device according to claim 37, wherein a rear part of said rear half-shell portion is received within said housing structure and a front part of said rear half-shell portion extends outwardly from said housing structure, said half-shell portion having a set of screw length markings provided on an exterior surface thereof, said screw length markings being positioned and configured such that an operator can disengage said door structure from said locking teeth, move said workpiece contacting structure to an adjusted position wherein an edge of said housing structure is aligned with one of said screw length markings corresponding to a desired screw length, and then engage said door structure with said locking teeth to thereby fix said adjustable workpiece contacting structure at the position corresponding to the desired screw length.

39. A power-operated screwdriving device according to claim 38, wherein said workpiece contacting portion is fastened to said rear half-shell portion by a pair of fasteners.

40. A power-operated screwdriving device according to claim 39, further comprising:

screw depth setting structure providing a feeding assembly engaging surface, said screw depth setting structure being positioned and configured such that said feeding assembly engaging surface engages a rearward surface of said workpiece contacting structure to thereby limit the relative movement occurring between said bit member and said workpiece engaging surface during said screwdriving operation;

said workpiece engaging surface and said rotatable screw engaging bit member being constructed and arranged such that, when said workpiece contacting structure is engaged with the feeding assembly engaging surface, a distance between a screw engaging end portion of said bit member and said workpiece engaging surface determines the depth to which the lead screw will be driven relative to the surface of the workpiece during said screwdriving operation;

a manually engageable screw depth adjusting member disposed exteriorly of said housing structure and operatively connected to said screw depth setting structure, said screw depth adjusting member being constructed and arranged such that manual operation thereof moves said screw depth setting structure through a range of adjustable positions to thereby adjust the depth to which the lead screw will be driven to the surface of the workpiece during said screwdriving operation.

41. A power-operated screwdriving device according to claim 40, wherein said screw depth setting structure is mounted for rotational movement within said housing structure, said feeding assembly engaging surface having a helical configuration and being aligned coaxially with said screw engaging bit member such that manual movement of said screw depth adjusting member rotates said screw depth setting structure through the range of adjustable positions.

42. A power-operated screwdriving device according to claim 41, further comprising a motion transmitting structure operatively connecting said screw depth adjusting member and said screw depth setting structure such that manual movement of said screw depth adjusting member causes rotation of said screw depth setting structure.

43. A power-operated screwdriving device according to claim 42, wherein said screw depth setting structure has a set of circular gear teeth formed thereon, said motion transmitting structure being a worm gear, said worm gear being operatively connected with said screw depth adjusting member and intermeshed with said set of gear teeth on said screw depth setting structure such that movement of said screw depth adjusting structure rotates said worm gear so as to cause rotation of screw depth setting structure through said range of adjustable positions.

44. A power-operated screwdriving device according to claim 43, wherein said screw depth adjusting structure is a manually engageable knob disposed on the exterior of said housing structure and fixedly connected to said worm gear such that rotation of said knob rotates said worm gear.

45. A power-operated screwdriving device according to claim 44, wherein said housing structure has a depth setting structure viewing window formed therethrough, said screw depth setting structure and said depth setting structure viewing window being positioned and configured such that the distance between said screw engaging end portion of said bit member and said workpiece engaging surface is related to an amount of viewing area in said viewing window occupied by said screw depth setting structure, thereby allowing an operator to determine the depth to which the lead screw will be driven by looking into said viewing window.

46. A power-operated screwdriving device according to claim 45, wherein said rearward surface of said workpiece contacting structure has a helical configuration complementing the helical configuration of said feeding assembly engaging surface.

47. A power-operated screwdriving device configured to be used with a supply of screws releasably mounted on a collation, said screwdriving device comprising:

a housing structure having an depth setting structure access opening;

a rotary power source carried by said housing structure;

a feeding assembly defining a drive track carried by said housing and providing a workpiece engaging surface;

said drive track being configured to receive a lead screw from the supply of screws;

a rotatable screw engaging bit member constructed and arranged to be operatively connected to the rotary power source such that the rotary power source rotates said screw engaging bit member during a screwdriving operation wherein said workpiece engaging surface is engaged with a surface of a workpiece and the lead screw is driven into the workpiece;

said rotatable screw engaging bit member being movable relative to said drive track and said workpiece engaging surface such that, when said workpiece engaging surface is engaged with the surface of the workpiece, rotation of said bit member and relative movement between said bit member and said drive track drives the lead screw into the workpiece during the screwdriving operation;

screw depth setting structure located within said housing and providing a feeding assembly engaging surface that extends helically with respect to an axis of said depth setting structure, said screw depth setting structure being positioned and configured such that said feeding assembly engaging surface engages said feeding assembly to thereby limit the relative movement occurring between said screw engaging bit member and said workpiece engaging surface during said screwdriving operation, said depth setting structure being turnable about said axis thereof so that the amount of said relative movement occurring between said screw engaging bit member and said workpiece engaging surface during said screwdriving operation for each angular position of said depth setting structure is determined by the orientation of said helically extending depth setting structure;

said workpiece engaging surface and said rotatable screw engaging bit member being constructed and arranged such that, when said feeding assembly is engaged with the feeding assembly engaging surface, a distance between a screw engaging end portion of said bit member and said workpiece engaging surface determines the depth to which the lead screw will be driven relative to the surface of the workpiece during said screwdriving operation;

a manually engageable screw depth adjusting member disposed exteriorly of said housing structure and operatively connected to said screw depth setting structure through said depth setting structure access opening, said screw depth adjusting member being constructed and arranged such that manual operation thereof turns said screw depth setting structure about said axis thereof to orient said helically extending feeding assembly engaging surface for adjustment of the depth to which the lead screw will be driven to the surface of the workpiece during said screwdriving operation.

48. A power-operated screwdriving device configured to be used with a supply of screws releasably mounted on a collation, said screwdriving device comprising:

a housing structure;

a rotary power source carried by said housing structure;

a feeding assembly defining a drive track constructed and arranged to receive a lead screw from the supply of screws;

said feeding assembly including a body and an adjustable workpiece contacting structure mounted on said body, said workpiece contacting structure providing a workpiece engaging surface, a rotatable screw engaging bit member constructed and arranged to be operatively connected to the rotary power source such that the rotary power source rotates said bit member during a screwdriving operation wherein said workpiece engaging surface is engaged with a surface of a workpiece and the lead screw is driven into the workpiece;

said workpiece contacting structure being constructed and arranged to be moved relative to said body through a range of adjustable positions to enable said workpiece contacting structure to be positioned in accordance with a length of the lead screw proximal a penetrating end of the lead screw to thereby minimize a distance between the penetrating end and the surface of the workpiece prior to driving the lead screw into the workpiece;

a contacting structure locking structure movable rectilinearly between (1) a locking position wherein said locking structure engages said workpiece contacting structure to thereby limit movement of said workpiece contacting structure relative to said body within said range of adjustable positions and (2) an unlocked position wherein said locking structure is unlocked from said workpiece contacting structure to thereby allow said workpiece contacting structure to be moved through said range of adjustable positions; said rotatable screw engaging bit member being movable relative to said drive track and said workpiece engaging surface such that, when said workpiece engaging surface is engaged with the surface of the workpiece, rotation of said screw engaging bit member and relative movement between said screw engaging bit member and said drive track drives the lead screw into the workpiece during said screwdriving operation.

49. A power-operated screwdriving device configured to be used with a supply of screws releasably mounted on a collation, said screwdriving device comprising:

a housing structure;

a rotary power source carried by said housing structure;

a feeding assembly defining a drive track constructed and arranged to receive a lead screw from the supply of screws;

said feeding assembly including a body and an adjustable workpiece contacting structure mounted on said body, said workpiece contacting structure providing a workpiece engaging surface and a subsequent lead screw engaging surface opposite said workpiece engaging surface, a rotatable screw engaging bit member constructed and arranged to be operatively connected to the rotary power source such that the rotary power source rotates said bit member during a screwdriving operation wherein said workpiece engaging surface is engaged with a surface of a workpiece and the lead screw is driven into the workpiece;

said workpiece contacting structure being constructed and arranged to be moved relative to said body through a range of adjustable positions to enable said workpiece contacting structure to be positioned in accordance with a length of the lead screw wherein force applied to said device towards the workpiece when the workpiece engaging surface is engaged with the workpiece will cause limited relative movement between said contacting structure and said body until said subsequent lead screw engaging surface contacts a penetrating end of the subsequent lead screw so as to terminate relative movement between the workpiece contacting structure and said body so as to hold the supply of collated screws as the lead screw is being driven into the workpiece;

a contacting structure locking structure movable between (1) a locking position wherein said locking structure engages said workpiece contacting structure to thereby limit movement of said workpiece contacting structure relative to said body within said range of adjustable positions and (2) an unlocked position wherein said locking structure is unlocked from said workpiece contacting structure to thereby allow said workpiece contacting structure to be moved through said range of adjustable positions;

said rotatable screw engaging bit member being movable relative to said drive track and said workpiece engaging surface such that, when said workpiece engaging surface is engaged with the surface of the workpiece, rotation of said screw engaging bit member and relative movement between said screw engaging bit member and said drive track drives the lead screw into the workpiece during said screwdriving operation.

* * * * *